US008156652B2

(12) United States Patent
Takeuchi et al.

(10) Patent No.: US 8,156,652 B2
(45) Date of Patent: Apr. 17, 2012

(54) SHAVER

(75) Inventors: Toshihiro Takeuchi, Hikone (JP); Kazuyuki Ouchi, Hikone (JP); Takeshi Matsusaka, Hikone (JP)

(73) Assignee: Panasonic Corporation, Osaka (JP)

( * ) Notice: Subject to any disclaimer, the term of this patent is extended or adjusted under 35 U.S.C. 154(b) by 516 days.

(21) Appl. No.: 11/459,685

(22) Filed: Jul. 25, 2006

(65) Prior Publication Data

US 2007/0022607 A1 Feb. 1, 2007

(30) Foreign Application Priority Data

Jul. 29, 2005 (JP) ..... 2005/221826
Mar. 28, 2006 (JP) ..... 2006/089575

(51) Int. Cl.
*B26B 19/02* (2006.01)

(52) U.S. Cl. ..... 30/43.2; 30/43.92

(58) Field of Classification Search ..... 30/42, 43, 30/46.91, 43.1–43.3, 43.91–43.92, 43.923
See application file for complete search history.

(56) References Cited

U.S. PATENT DOCUMENTS 5,557,850 A * 9/1996 Mun ..... 30/43.92
6,418,623 B1 * 7/2002 Marcarelli ..... 30/50
6,892,457 B2 5/2005 Shiba et al.
7,017,270 B2 3/2006 Shiba et al.
2004/0055158 A1 3/2004 Izumi et al.
2005/0016002 A1 1/2005 Fukutani et al.
2005/0229400 A1 10/2005 Yamaguchi et al.
2006/0150421 A1 7/2006 Sato et al.

FOREIGN PATENT DOCUMENTS

EP 1403011 3/2004
JP 2005-040358 2/2005

OTHER PUBLICATIONS

English Language Abstract of JP 2005-040358.

* cited by examiner

*Primary Examiner* — Phong Nguyen
(74) *Attorney, Agent, or Firm* — Greenblum & Bernstein, P.L.C.

(57) ABSTRACT

It is possible to change a shaving area width that can be shaved at a time in accordance with a shaving portion, and to swiftly cut hair. The shaver includes a plurality of outer blade frames which hold a blade block for cutting hair. The outer blade frames are arranged in a direction Y intersecting with a moving direction X of a movable blade of the blade block. At least one of the outer blade frames can slide in the moving direction X of the movable blade from an initial position. The shaver has a fixing unit which fixes the outer blade frame at a sliding position.

15 Claims, 42 Drawing Sheets

SHAVER

CROSS REFERENCE TO RELATED APPLICATIONS

This application is based upon and claims the benefit of priority from prior Japanese Patent Application P2005-221826 filed on Jul. 29, 2005 and prior Japanese Patent Application P2006-08957 filed on Mar. 28, 2006; the entire contents of which are incorporated by reference herein.

BACKGROUND OF THE INVENTION

The present invention relates to a shaver for cutting hair.

FIGS. 1 and 2 show a conventional shaver 4' described in Japanese Patent Application Laid-open No 2005-40358 (Patent Document 1). In the shaver 4', a shaver main body 9' is provided at its upper portion with a plurality of outer blade frames 2' which hold a blade block 1' for cutting hair, and the outer blade frames 2' are arranged in a direction intersecting with a moving direction X of a movable blade of the blade block 1'.

According to the shaver disclosed in the Patent Document 1, the outer blade frames 2' are mounted on the shaver main body 9' such that the outer blade frames 2' can independently float or swing in accordance with pushing forces against a skin, and if a user grasps the shaver main body 9' and pushes the blade block 1' against his or her skin, the outer blade frames 2' float or swing along the unevenness or shape of the skin in a corresponding manner with respect to the unevenness or shape of the skin. According to the conventional shaver 4', however, a shaving area width M' which can be shaved at a time is the width of the longitudinal direction of the blade block shown in FIG. 1. Therefore, with a shaver 4' having a long blade block 1' in the X direction in FIG. 1, it is not possible to shave a narrow portion such as an armpit, and with a shaver 4' having a short blade block 1' in the X direction in FIG. 1, on the other hand, it is possible to shave the narrow portion such as the armpit, but since the area that can be shaved at a time is narrow when a wide portion such as a leg or an arm is shaved, there is a problem that it takes time to shave and ease of operation is poor.

SUMMARY OF THE INVENTION

The present invention has been achieved in view of the conventional problem, and it is an object of the invention to provide a shaver having excellent operating ease and capable of changing a shaving area width that can be shaved at a time in accordance with a shaving portion and capable of swiftly shaving.

To achieve the above object, the shaver according to the present invention includes a plurality of outer blade frame 2 each having a blade block 1 for cutting hair, the outer blade frame 2 are arranged in a direction perpendicular to a moving direction of a movable blade 39 of the blade block 1, at least one of the outer blade frame 2 can slide in the moving direction of the movable blade 39 from an initial position, and the shaver further includes a fixing unit 3 for fixing the outer blade frame 2 at a sliding position.

With this configuration, when hair in a portion having a narrow shaving area such as the armpit is to be cut, when hair in a portion where the shaving area width is narrow such as an armpit is to be cut, if the arranged outer blade frames 2 are used in the initial position, the shaver can easily come into contact with a skin even in a narrow portion such as the armpit and hair can be cut smoothly and swiftly and operability is excellent, and when hair in a portion having wide shaving area such as a leg and an arm is to be cut, the operating unit 2 are slid and the shaving area width M that can be shaved at a time by the shaver 4 is widened, the amount of hair that can be shaved with one stroke is increased and hair can be cut swiftly, and since the outer blade frames 2 are fixed by the fixing unit 3 at the sliding position, hair can be cut in a state where the shaving area width M set by the slide is maintained when the outer blade frames 2 are slid and the shaver is used, and hair can be cut stably and reliably.

It is preferable that the outer blade frame 2 can slide in different directions.

With this configuration, the shaving area width M that can be shaved at a time can efficiently be widened, the amount of hair that can be shaved with one stroke is increased and hair can be cut swiftly.

It is preferable that at least one of the outer blade frames 2 can slide, each of the outer blade frame 2 has the blade block 1, the movable blade 39 of the blade block 1 is driven by one drive source.

With this configuration, even though at least one of the arranged outer blade frames 2 can slide in the moving direction of the movable blade 39, only one drive source suffices, the weight is reduced, the number of members is reduced and the structure can be simplified.

It is preferable that a drive element 8 which is driven by a drive source (e.g., a motor 11) and which reciprocates the movable blade 39 is divided into a drive source-side drive element portion 42 on a drive source side and a movable blade-side drive element portion 41 on a movable blade-side, the movable blade-side drive element portion is mounted on the drive source-side drive element portion 42 such that the movable blade-side drive element portion can slide in a reciprocating direction of the movable blade 39.

With this configuration, it is possible to employ a structure for preventing hair chips and water from entering the shaver main body 9 at a portion of the drive source-side drive element portion 42 which is driven by the drive source and which reciprocates and thus, the movable blade-side drive element portion 41 can slide irrespective of the structure which prevents hair chips and water from entering the shaver main body 9, the structure of the sliding portion can be simplified, the entire shaver can be reduced in size and the operability is enhanced.

It is preferable that a plurality of movable blade-side drive element portions slide in association by a drive element associating unit.

If one of the movable blade-side drive element portions 41 is slid, the other movable blade-side drive element portion 41 can slide in association, and the operability is enhanced.

It is preferable that the shaver further includes a drive element connecting unit 44 which connects the movable blade-side drive element portion 41 and the drive source-side drive element portion 42, and a spring member 45 which slides the movable blade-side drive element portion from the initial position to a sliding position or from the sliding position to the initial position with respect to the drive source-side drive element portion 42.

With this configuration, the movable blade 39 can be reciprocated by driving force from the drive source in a state where the movable blade-side drive element portion 41 and the drive source-side drive element portion 42 are connected to each other by the drive element connecting unit 44, and the movable blade-side drive element portion 41 can slide with respect to the drive source-side drive element portion 42 in a state where the connection established by the drive element connecting unit 44 is released, and if the connection established by the drive element connecting unit 44 is released, the movable blade-side drive element portion 41 can slide from the initial position to the sliding position or from the sliding position to the initial position with respect to the drive source-side drive element portion 42 by the spring member 45, and the sliding operation can be easily carried out.

It is preferable that the movable blade-side drive element portion 41 and the drive source-side drive element portion 42 can slide by a rail structure including a recess 46 and a protrusion 47, the rail structure is provided at its end with a stopper 48 for a sliding motion.

With this configuration, the movable blade-side drive element portion 41 can be allowed to slide with respect to the drive source-side drive element portion 42 with a simple structure, and the sliding motion can be stopped at the connection position reliably.

It is preferable that the drive element connecting unit 44 includes a drive element lock member 49 which is biased by a spring provided on the drive source-side drive element portion 42, and a lock hole 50 into which the drive element lock member 49 provided on the movable blade-side drive element portion 41 can be fitted, the drive element lock member 49 is fitted into the lock hole and a position of slide of the movable blade-side drive element portion 41 is fixed.

With this configuration, the movable blade-side drive element portion 41 can be connected to the drive source-side drive element portion 42 at the sliding position reliably with a simple structure.

It is preferable that the plurality of outer blade frame 2 slide by an outer blade frame 2 associating unit 51 in association.

With this configuration, if one of the outer blade frames 2 slides, the other outer blade frames 2 slides in association by the outer blade frame associating unit 51, a using mode in which the shaving area width M that can be shaved at a time by the shaver 4 is widened and a using mot in which the shaving area width M is narrowed can be established, the using mode can easily be changed and the operability is enhanced.

It is preferable that the outer blade frame 2 is mounted on a shaver main body 9 such that the outer blade frame 2 can slide in a reciprocating direction of the movable blade 39, the fixing unit 3 of the outer blade frame 2 includes a frame lock member 53 biased by a spring provided on the side of the shaver main body 9, and a lock hole 50 into which the frame lock member 53 provided on the outer blade frame 2 can be fitted, the frame lock member 53 is fitted into the lock hole 50 and a slide position of the outer blade frame 2 is fixed.

With this configuration, the sliding position of the outer blade frame 2 which slides can reliably be fixed with a simple structure.

It is preferable that the shaver further includes an arrangement direction position holding unit which holds a positional relationship of the arranged outer blade frame 2 in an arrangement direction.

With this configuration, it is possible to prevent the arranged outer blade frames 2 from opening and narrowing in the arrangement direction by the arrangement direction position holding unit 55, the shaver can be used stably and the sliding motion can be stably and smoothly carried out in the using mode in which the shaving area width M is widened and in the using mode in which the shaving area width M is narrowed.

It is preferable that the outer blade frame 2 is provided with a connecting member 56 which detachably connects the movable blade-side drive element portion 41 and the outer blade frame 2 with each other, the outer blade frame 2 and the movable blade-side drive element portion 41 can slide simultaneously in a state where the outer blade frame 2 and the movable blade-side drive element portion 41 are connected to each other by the connecting member 56, and the movable blade-side drive element portion 41 can reciprocate in the outer blade frame 2 in a state where the outer blade frame 2 and the movable blade-side drive element portion 41 are not connected to each other by the connecting member 56.

With this configuration, in a state where the movable blade-side drive element portion 41 and the outer blade frame 2 are connected to the outer blade frame 2 by the connecting member 56, the outer blade frame 2 and the movable blade-side drive element portion 41 can slide simultaneously by releasing the fixed state by the fixing unit 3, the using mode in which the shaving area width M is widened and the using mode in which the shaving area width M is narrowed can be switched with one operation, the operability is enhanced, the number of parts can be reduced with a simple structure, and the shaver can be made compact.

It is preferable that the shaver further includes a common operating unit 57 which releases the connection between the movable blade-side drive element portion 41 and the drive source-side drive element portion 42 established by the drive element connecting unit 44, releases the connection between the shaver main body 9 and the outer blade frame 2 established by the fixing unit 3 of the outer blade frame 2, and connects the movable blade-side drive element portion 41 and the outer blade frame 2 to each other by the connecting member 56.

With this configuration, when the outer blade frame 2 and the movable blade-side drive element portion 41 are slid in association, it is possible to release the connection by the drive element connecting unit 44, to release the connection by the fixing unit 3, and to connect by the connecting member 56 with one operation of the operating unit 57, the operating manner is enhanced and the operability is improved.

It is preferable that in a state where the outer blade frame 2 is slid in the moving direction of the movable blade 39 from the initial position, a shaving area width M established by the outer blade held by the arranged outer blade frame 2 is widened, the arranged outer blades are formed such that both ends of the shaving area width M project more than a central portion thereof.

With this configuration, when the shaving area width M is widened and hair of an arm or a leg is to be cut, the outer blade easily comes into close contact with a curved surface of the arm or the leg, unshaved portion is small, and hair can be cut swiftly.

It is preferable that the shaver further includes an output side gear 5 which outputs a driving force, a drive gear 6 to which rotation is transmitted from the output side gear 5 and which rotates, a drive element 8 which converts the rotation of the drive gear into a reciprocating motion through an eccentric cam 7 and which reciprocates the movable blade 39 of the outer blade frame 2, a plurality of output side gears, wherein the drive gear, the eccentric cam 7 and the drive element 8 slide together with the outer blade frame 2, the driving force is transmitted to the drive gear 6 through different output side gears 5 in the initial position and the sliding position of the outer blade frame 2.

With this configuration, in a state where the outer blade frame 2 is slid, the driving force is transmitted and the movable blades 39 provided on the plurality of outer blade frames 2 can reciprocate, and the structure can be simplified.

DETAILED DESCRIPTION OF THE PREFERRED EMBODIMENTS

Embodiments of the present invention will be explained below with reference to the drawings.

FIGS. 3 to 12 show one embodiment of the present invention, and FIGS. 13 to 36 show other embodiments of the invention.

First, the embodiment shown in FIGS. 3 to 12 will be explained.

Figure 1:
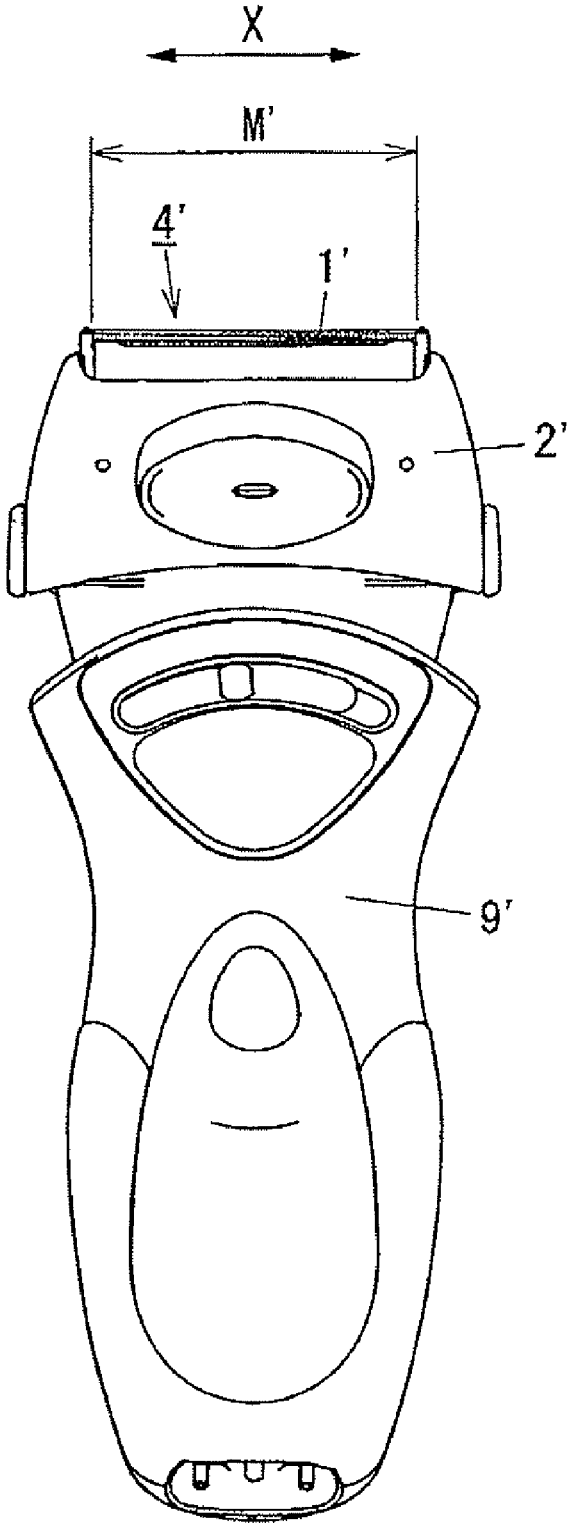
FIG. 1 RELATED ART
FIG. 1 is a front view of a shaver of a conventional example.
Figure 2:
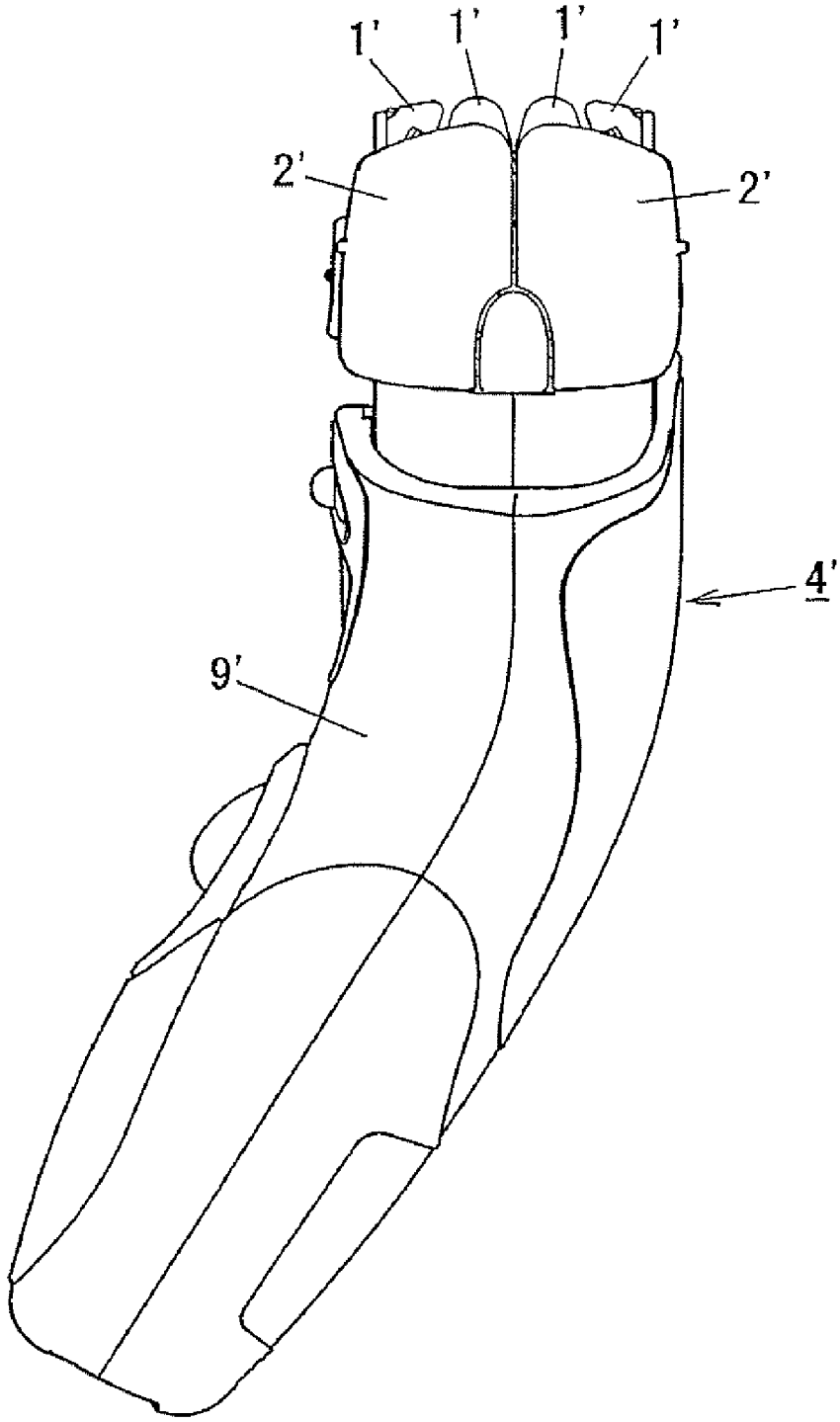
FIG. 2 RELATED ART
FIG. 2 is a side view of the shaver of the conventional example.
Figure 3:
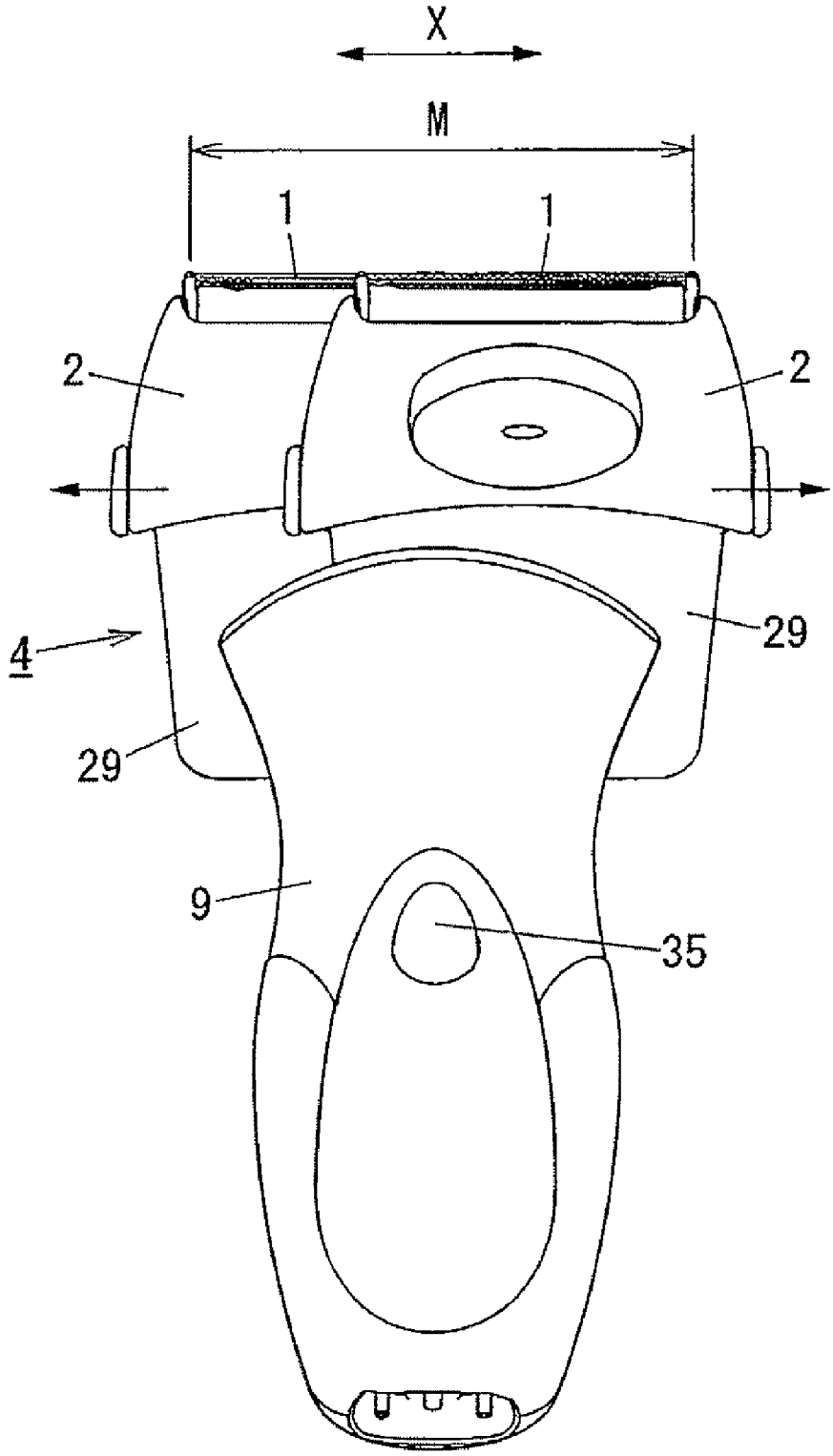
FIG. 3 is a front view when an outer blade frame of a shaver according to the present invention is slid to elongate a shaving area width.
Figure 4:
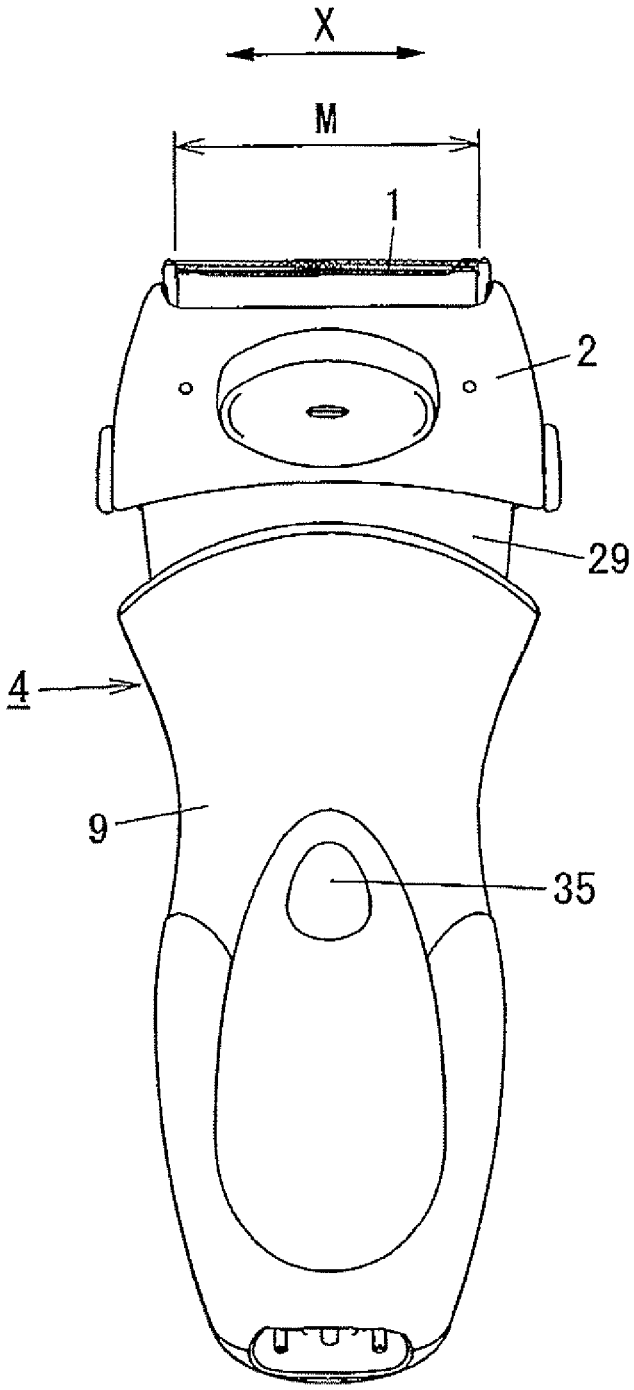
FIG. 4 is a front view when the outer blade frame of the shaver is located at an initial position and the shaving area width is short.
Figure 5:
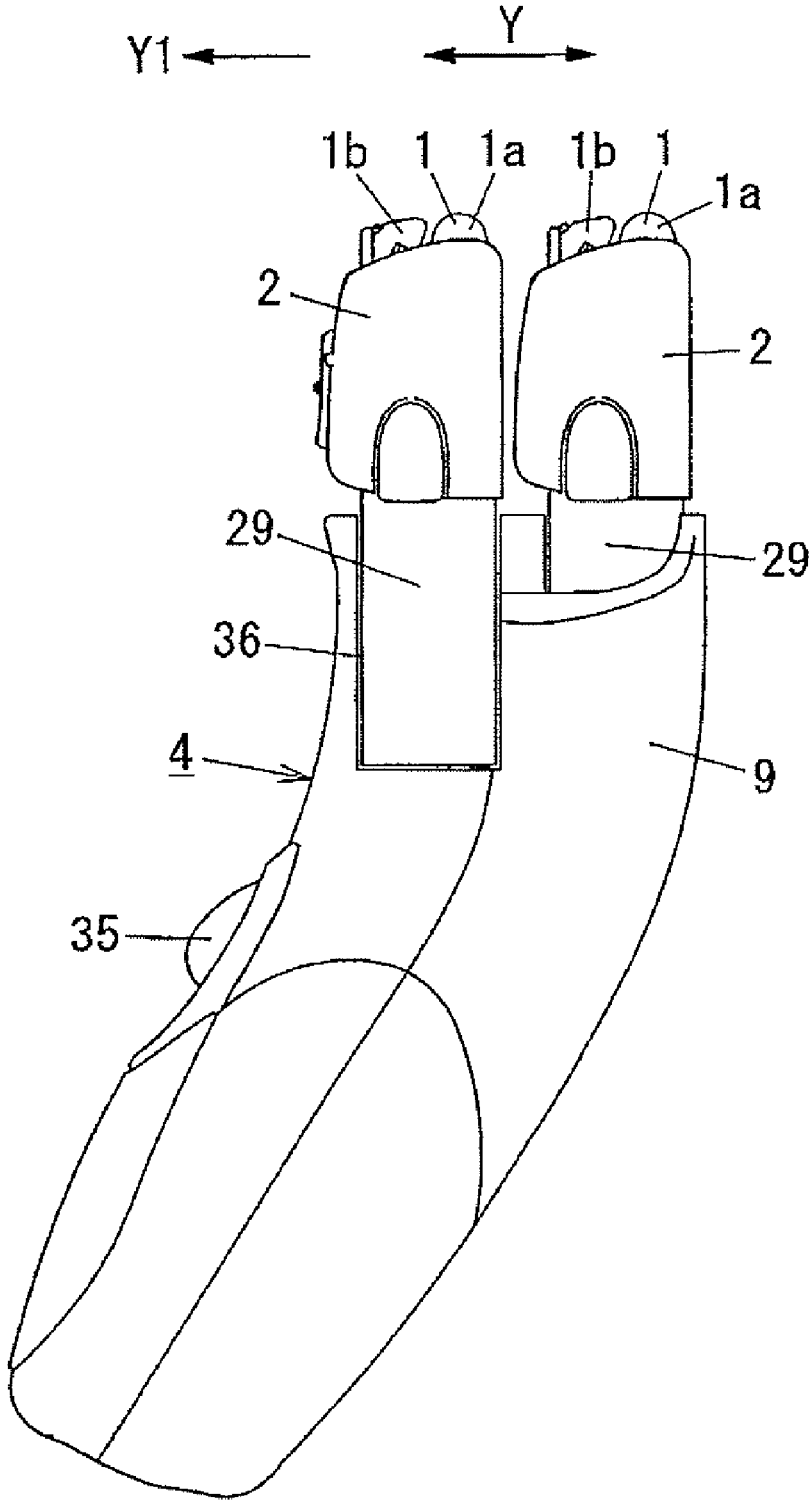
FIG. 5 is a side view of the shaver.

As shown in FIGS. 3 to 5, a shaver 4 according to the present invention includes a shaver main body 9 which is a grip to be griped by a hand of a user, and a plurality of outer blade frames 2 provided on an upper portion of the shaver main body 9. The outer blade frames 2 hold a blade block 1 for cutting hair. The outer blade frames 2 are arranged in a direction intersecting with a moving direction X of a movable blade of the blade block 1. The moving direction of the movable blade is defined as X direction (lateral direction), and the arrangement direction of the outer blade frames 2 intersecting with the X direction is defined as Y direction (longitudinal direction). A direction intersecting with both the X direction and Y direction at right angles is defined as a vertical direction, a side of the shaver main body 9 closer to the blade block 1 is defined upside, and the opposite side is defined downside.

FIGS. 6 to 12 show one embodiment of a driving force transmitting mechanism of the present invention.

The shaver main body 9 has a housing 52 as a main body, and an upper base 10 is mounted on an upper portion of the housing 52.

A motor 11 is fixed to the upper base 10 by screws 12. An output side main gear 5*a* is press fitted and fixed to an output shaft 13 of the motor 11. Bearing bosses 14 project from the upper base 10, and shafts 15 as rotation fulcrums of output side auxiliary gears 5*b* and 5*b* are press fitted and fixed to bearing bosses 14. The output side auxiliary gears 5*b* and 5*b* are engaged with the out put side main gear 5*a* so that power of the output side main gear 5*a* is transmitted to the output side auxiliary gears 5*b* and 5*b*. In the embodiment shown in the attached drawings, the output side main gear 5*a* is located at a center portion of the upper base 10, and the output side auxiliary gears 5*b* and 5*b* are disposed on opposite sides of the output side main gear 5*a* in the X direction (lateral direction). The output side main gear 5*a* and the output side auxiliary gears 5*b* and 5*b* constitute output side gears 5. That is, in the present embodiment, total three output side gears 5, i.e., one output side main gear 5*a* and two output side auxiliary gears 5*b* and 5*b* are provided.

A pair of projections 16 project from opposite sides of an upper surface of the upper base 10 in the Y direction (longitudinal direction) such as to be opposed to both ends in the X direction. Two slide shaft inserting holes 17 are formed in each of the pair of projections 16 which are opposed to each other in the X direction. A slide shaft 18 is inserted into each of the opposed slide shaft inserting holes 17 so that two slide shafts 18 extend between the opposed pairs of projections 16. In this manner, one set, i.e., two slide shafts 18 extend between the both sides of the upper base 10 in the X direction, and are parallel to each other in the Y direction.

Two slide holes 20 provided in lower ends of drive element bases 19 are slidably fitted into the one set, i.e., two slide shafts 18, the drive element base 19 are slidably mounted on the upper base 10 in the X direction so that the drive element bases 19 are slidably mounted on both sides of the output side gears 5 in the Y direction.

Figure 6:
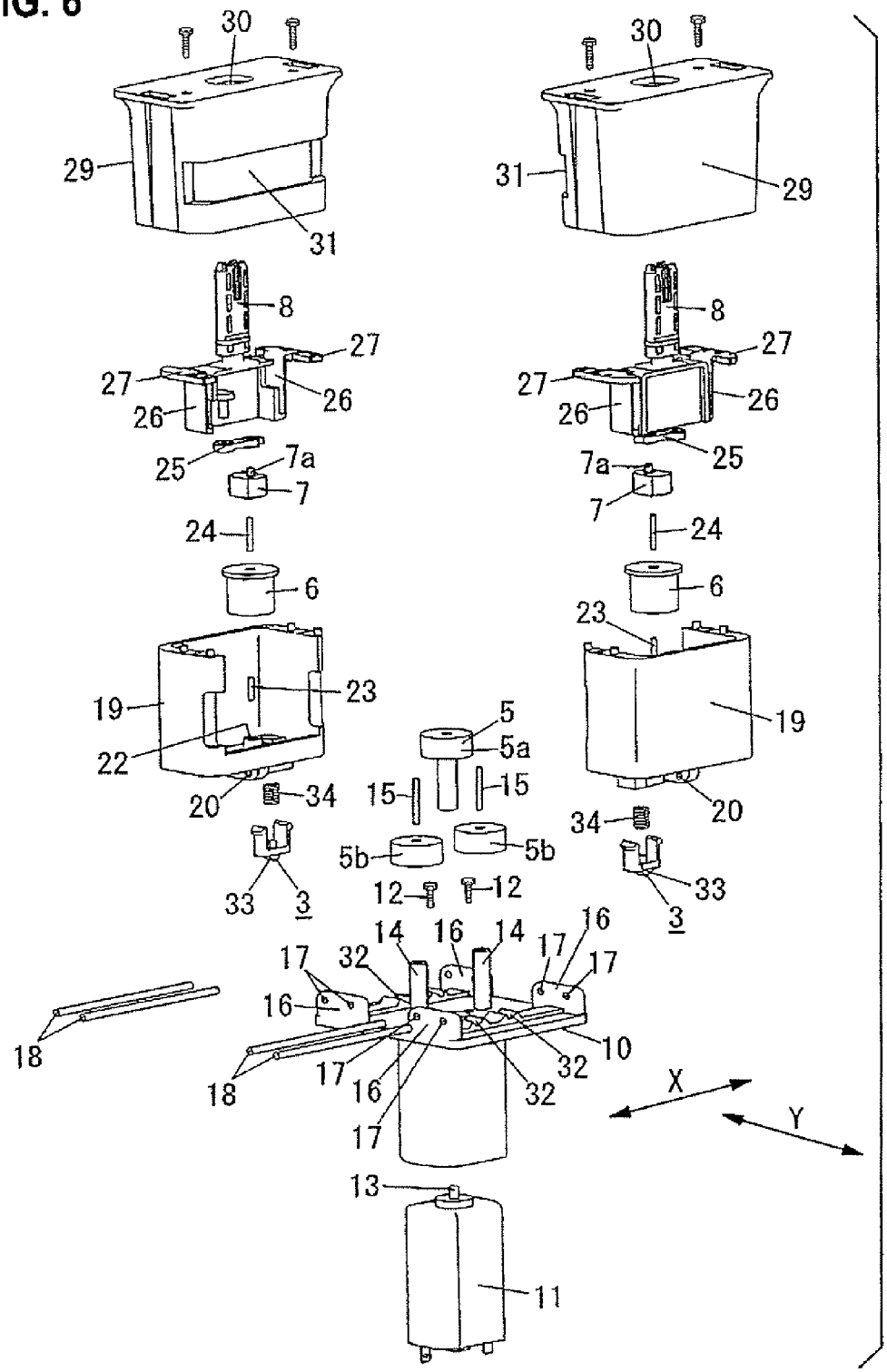
FIG. 6 is a partially omitted exploded perspective view of the shaver.

As shown in FIG. 6, each of the drive element base 19 is of a hollow structure. An upper side of the drive element base 19 and a side thereof facing the output side gear 5 are opened. A shaft 23 is press fitted and fixed to a boss 22 provided on the bottom of the follow interior of the drive element base 19. A drive gear 6 is pivotally supported by the shaft 23. An eccentric cam 7 having a balancer weight is fixed to each of the drive gears 6 through the shaft 24. One end of the drive arm 25 is rotatably supported on an eccentric shaft 7*a* (eccentric with respect to ration center of the drive gear 6) of the eccentric cam 7.

Figure 10:
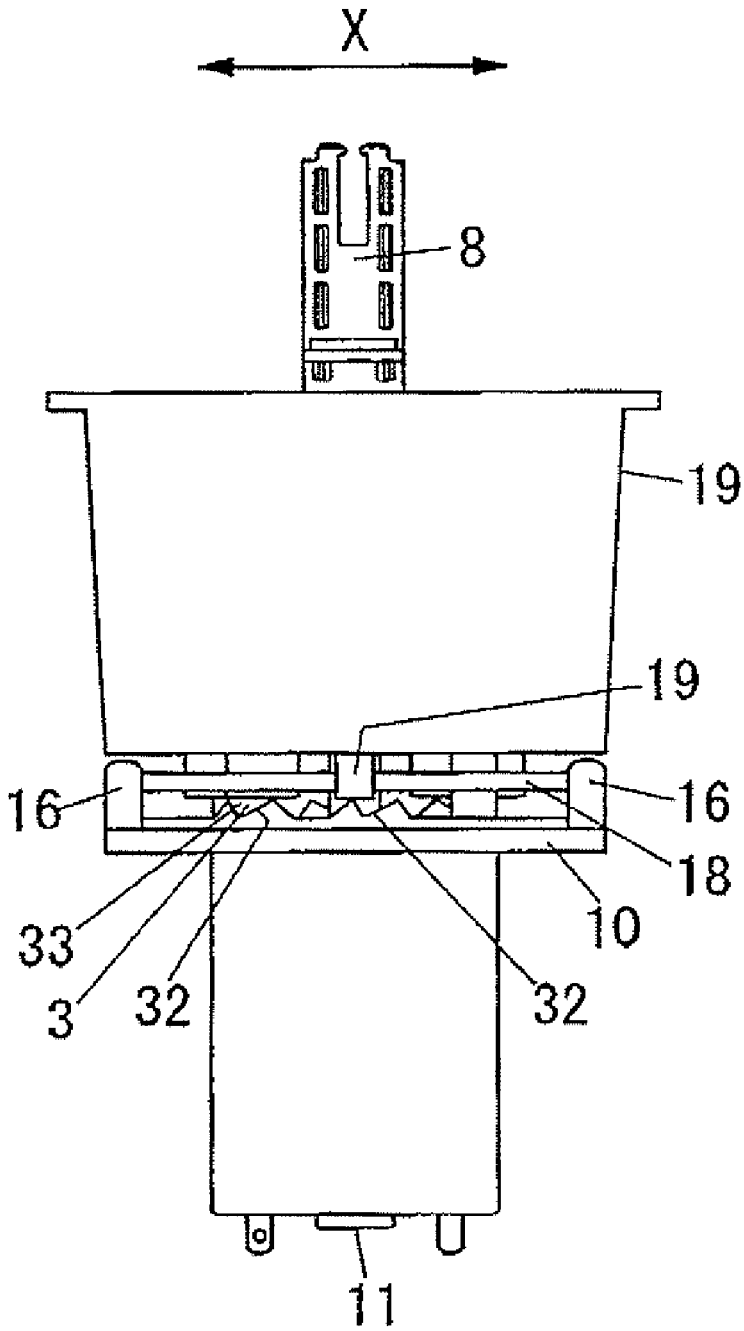
FIG. 10 is a front view of the driving force transmitting mechanism when the outer blade frame is located at an initial position and the shaving area width is narrow.
Figure 11:
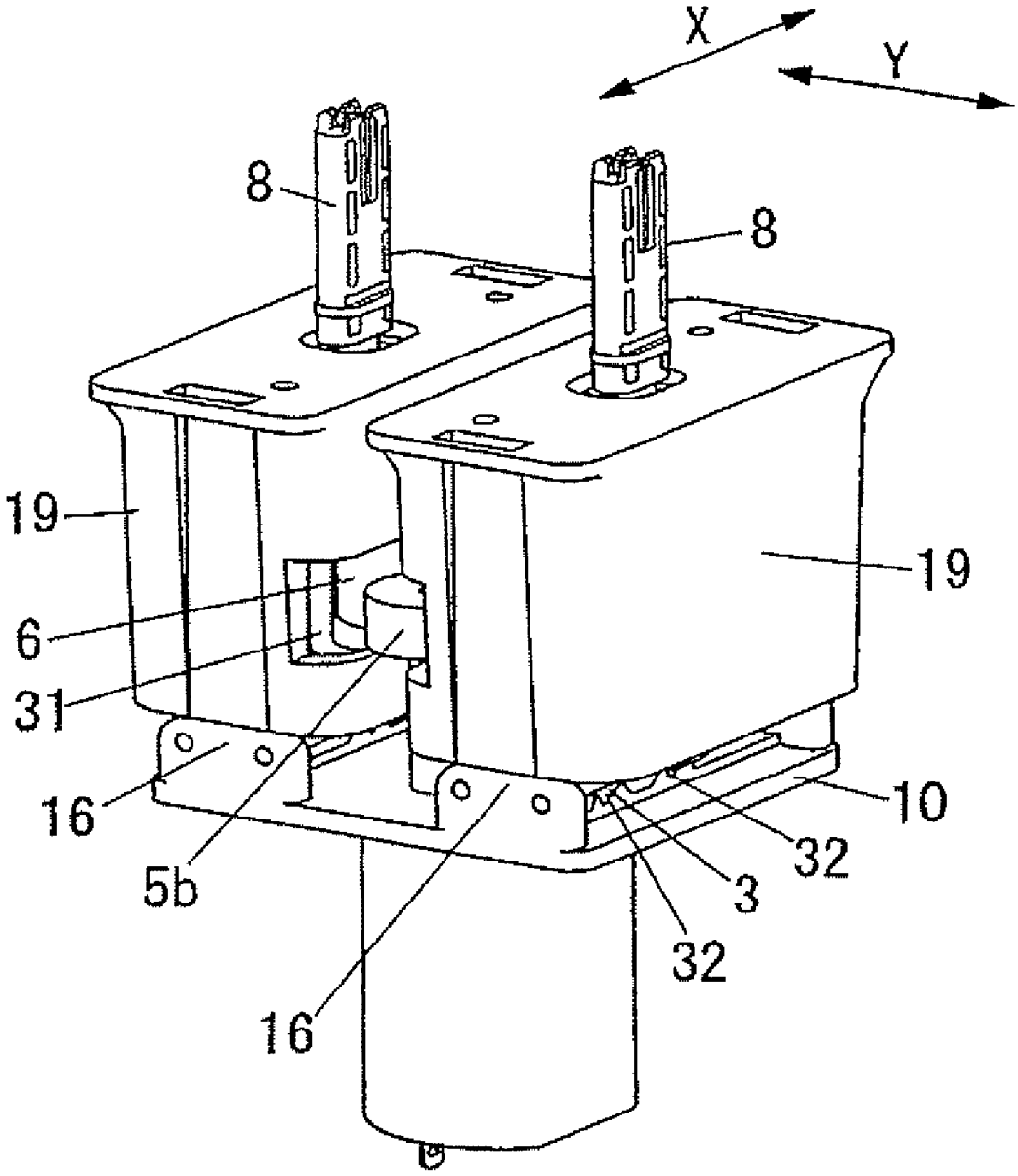
FIG. 11 is a perspective view of the driving force transmitting mechanism portion when the outer blade frame is located at the initial-position and the shaving area width is narrow.
Figure 12:
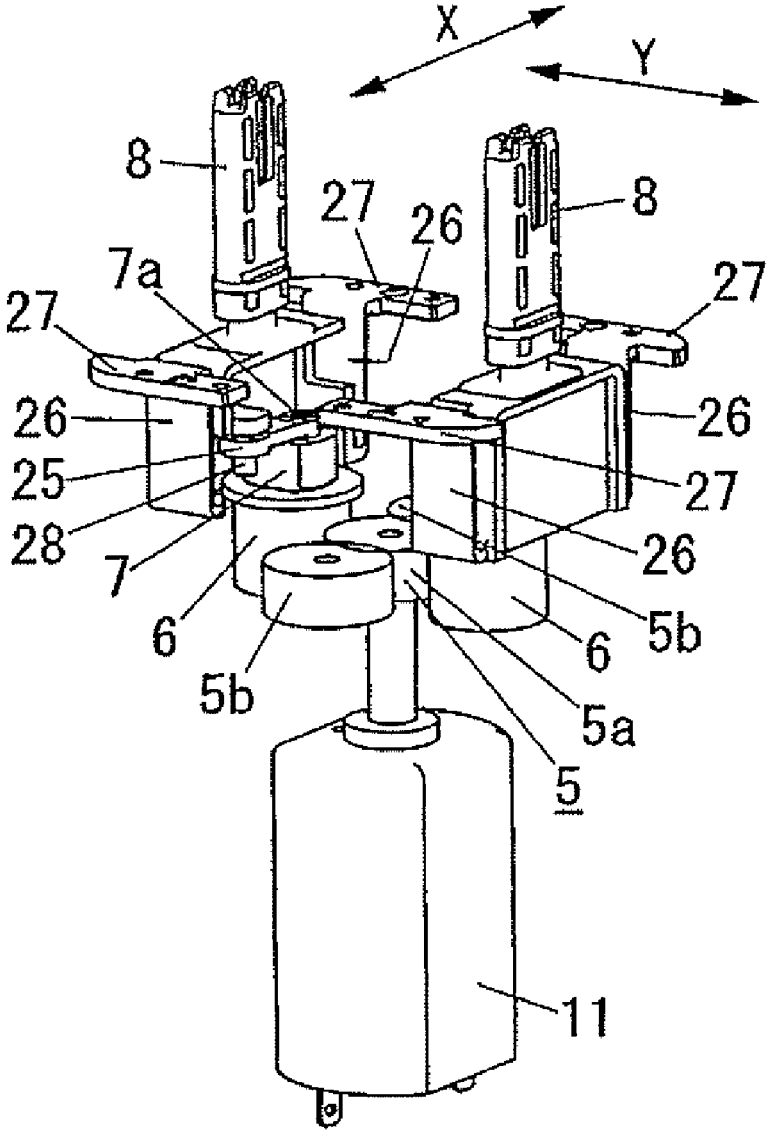
FIG. 12 is a partially omitted perspective view of the driving force transmitting mechanism portion when the outer blade frame is located at the initial position and the shaving area width is narrow.

As shown in FIGS. 10 to 12, at a position (an initial position) where both the drive element bases 19 are arranged such that they are superposed on each other in the Y direction, the drive gears 6 provided on the drive element bases 19 are engaged with the output side main gear 5*a* of the plurality of output side gears 5. In this state, power from the output side main gear 5*a* is transmitted to both the drive gears 6.

Figure 7:
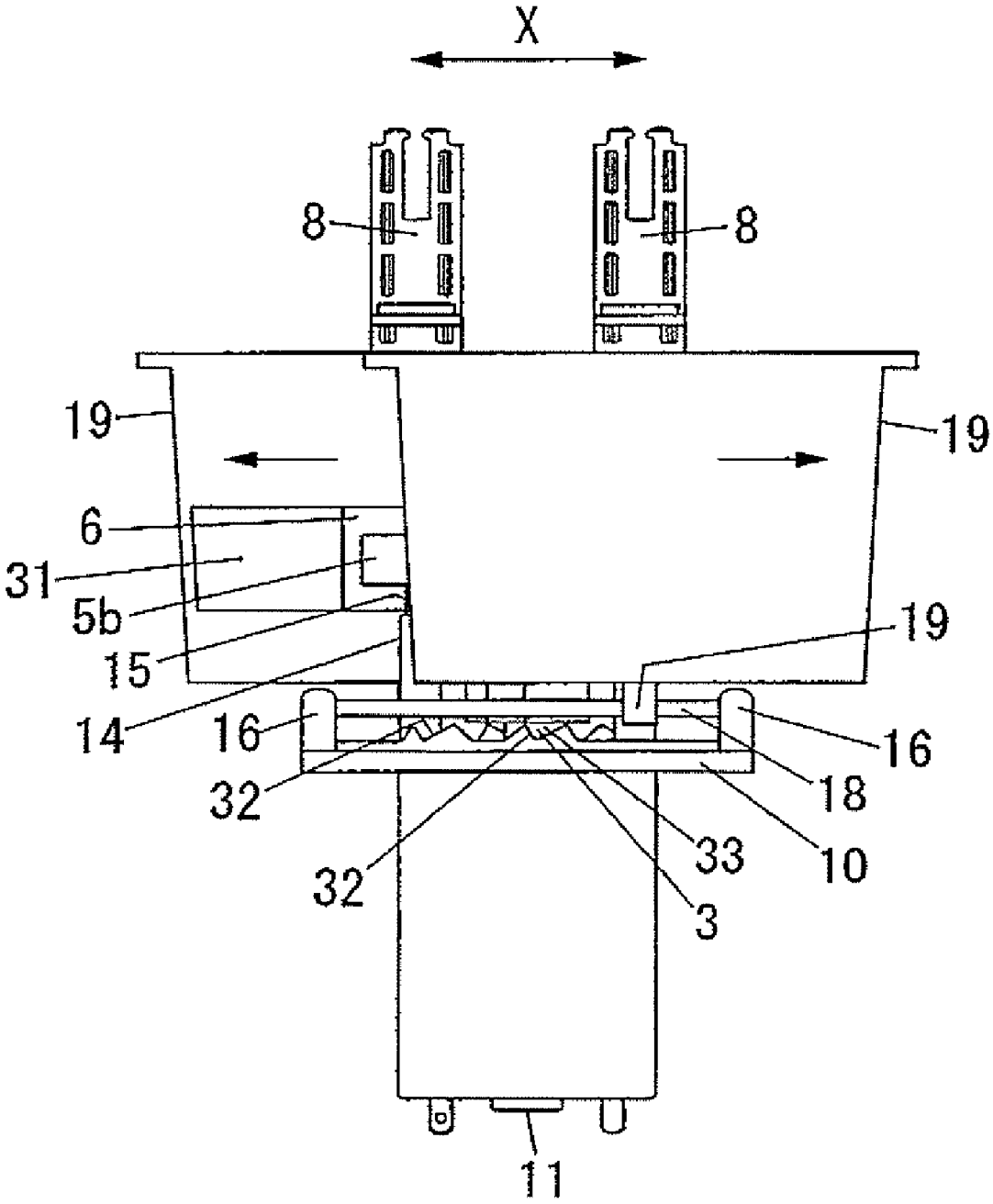
FIG. 7 is a front view of a driving force transmitting mechanism when the outer blade frame is slid to elongate the shaving area width.
Figure 8:
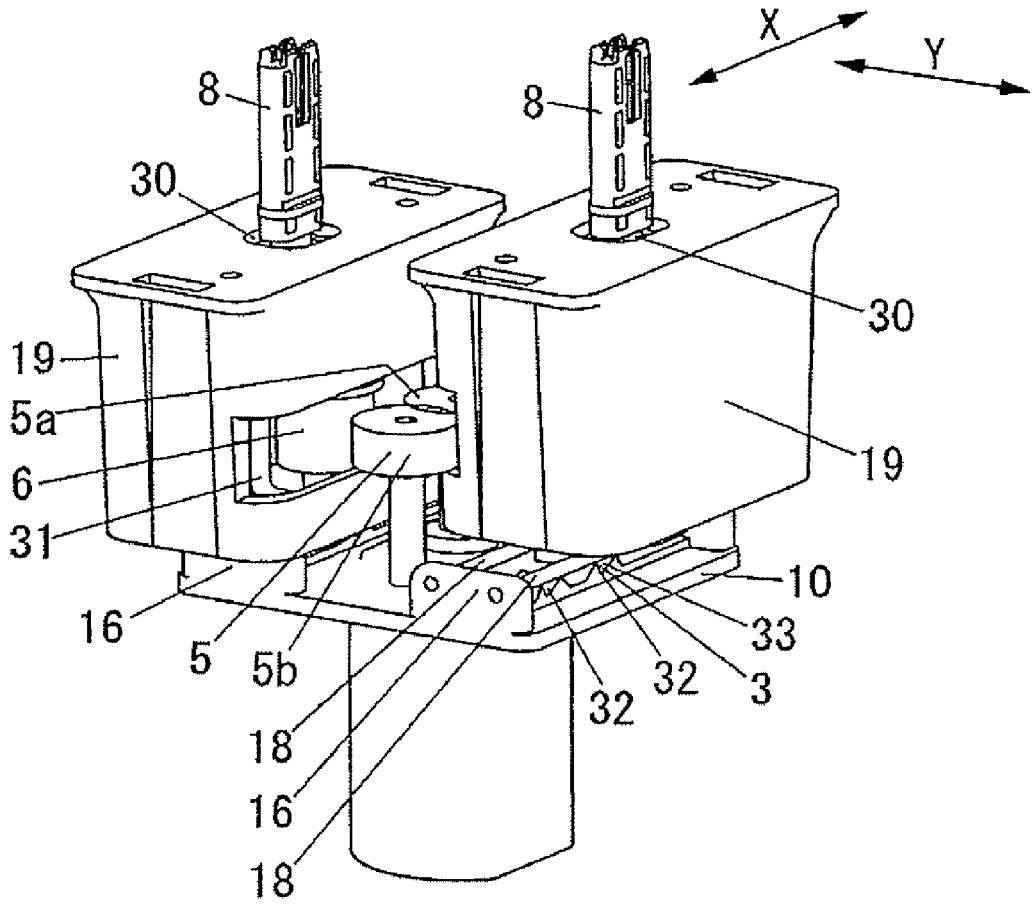
FIG. 8 is a perspective view of the driving force transmitting mechanism portion when the outer blade frame is slid to elongate the shaving area width.
Figure 9:
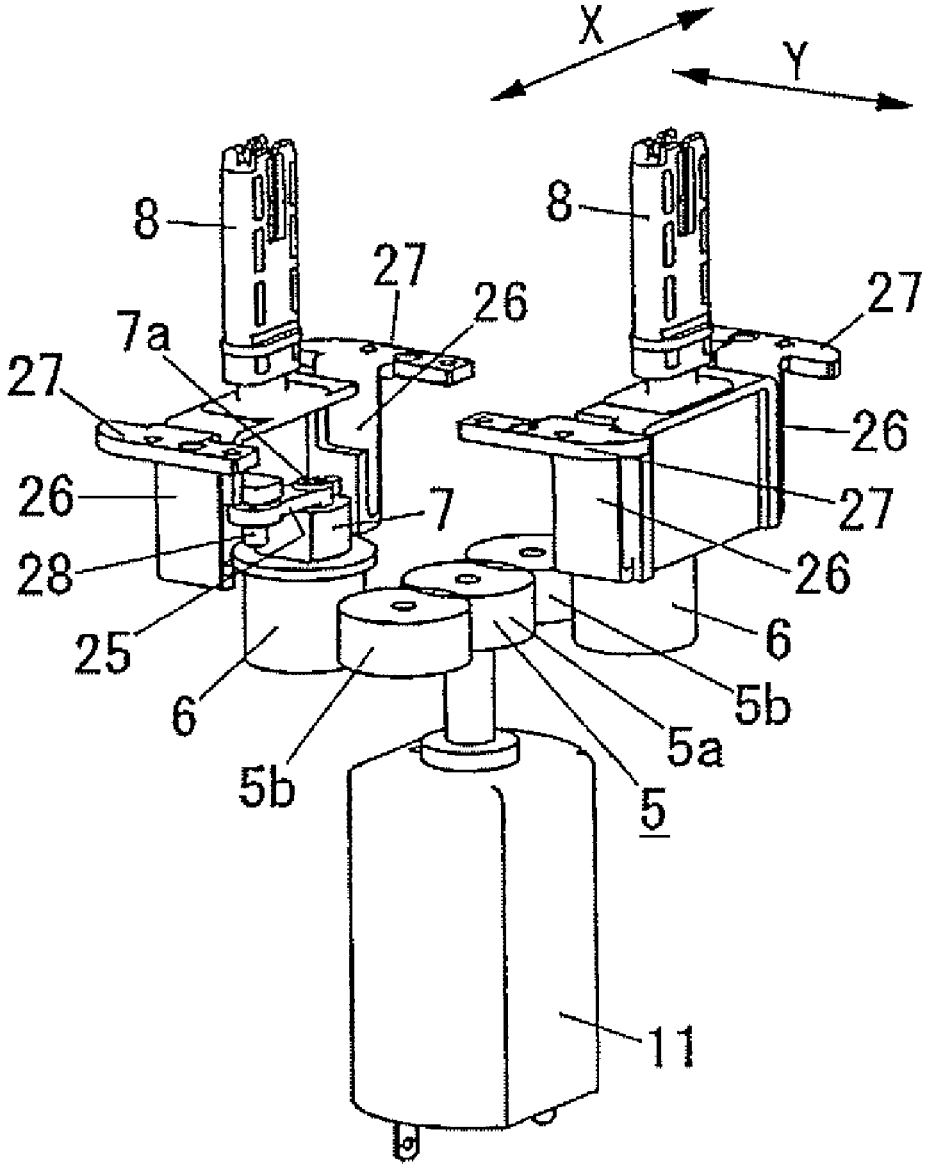
FIG. 9 is a partially omitted perspective view of the driving force transmitting mechanism portion when the outer blade frame is slid to elongate the shaving area width.

As shown in FIGS. 7 to 9, if both the drive element bases 19 are separated away from each other in the Y direction, one of the drive gears 6 is engaged with one of the output side auxiliary gears 5*b* and 5*b* and power is transmitted, and the other drive gear 6 is engaged with the one output side auxiliary gear 5*b* and power is transmitted.

Although it is not shown in the drawings, it only one of the drive element bases 19 is moved in the Y direction, one of the drive gears 6 is engaged with the one of the output side auxiliary gears 5*b* and 5*b* and power is transmitted, and the other drive gear 6 is engaged with the central output side main gear 5*a* and power is transmitted.

As shown in FIG. 6, a plurality of (two in the shown embodiment) retaining units 32 are provided on both sides of the upper surface of the upper base 10 in the X direction. A lock member 33 is vertically movably mounted on a lower end of each drive element base 19. The lock member 33 resiliently projects by a spring 34. As shown in FIG. 10, when the drive element base 19 is in the initial position, the lock member 33 is resiliently engaged with one of the retaining units 32, thereby fixing the drive element base 19 at the initial position. If an external force greater than the retaining force caused by the spring is applied, the drive element base 19 can be slid in the X direction against the spring. As shown in FIG. 7, if the lock member 33 resiliently engages another retaining unit 32 at a predetermined slide position, the drive element base 19 can be fixed to the predetermined slide position. The retaining units 32 and the lock member 33 constitute the fixing unit 3.

A drive element 8 is mounted on each of the drive element bases 19. The drive element a is provided at its both sides with fixing units 27 through the resilient pieces 26. A lower end of the drive element 8 is inserted into a gap of the drive element base 19 and the fixing units 27 located on the both sides in the X direction are fixed to both edges of upper openings of the drive element bases 19 in the X direction, thereby mounting the same on the drive element base 19 such that it can be moved only in the X direction by the resilient piece 26. The other end of the drive arm 25 is rotatably supported by a shaft portion 28 provided on the drive element 8. Thus, if the drive gear 6 rotates, the rotation motion is converted into a straight reciprocating motion through the eccentric cam 7 and the drive arm 25, and the drive element 8 is reciprocated only in the X direction.

As described above, the drive element base 19 can move in the X direction, and a frame mounting stage 29 is fitted over the drive element base 19 as shown in FIGS. 7, 8, 10, and 11. An upper portion of each of the drive elements 8 projects upward from a hole 30 of the frame mounting stage 29. The hole 30 has such a size that the reciprocating motion of the drive element 8 is not hindered. An opening 31 is formed in a side surface on the frame mounting stage 29 facing the output side gear 5.

The outer blade frames 2 are respectively detachably mounted on the plurality of (two in the shown embodiment) frame mounting stages 29 arranged and mounted in the Y direction.

The blade block 1 for cutting hair is supported on the outer blade frame 2. The blade block 1 is provided with blades for cutting hair. The blades include an outer blade and a movable blade (an inner blade). The movable blade is detachably connected to an upper portion of the drive element, and the movable blade reciprocates by the reciprocating motion of the drive element 8 in the X direction. The movable blade cuts hair which is introduced from the hole formed in the outer blade.

In the embodiment shown in the accompanying drawings, the outer blade frame 2 has two blade blocks 1, i.e., a short hair cutting blade block 1*a* for cutting short hair and a long hair cutting blade block 1*b* for cutting long hair.

The short hair cutting blade block 1*a* includes an outer blade by a net blade. In a state where a movable blade (an inner blade for cutting short hair) connected to an upper end of the drive element 8 is resiliently pushed against a lower surface side of the net blade by a spring material, the drive element 8 reciprocates in the X direction as described above, the movable blade reciprocates in the X direction, and short hair introduced from net holes of the net blade is cut.

The long hair cutting blade block 1*b* includes an outer blade by a slit blade. A movable blade for cutting long hair (an inner blade for cutting long hair) is resiliently pushed against a lower surface of the slit blade by a spring material. The movable blade is connected to the drive element 8 or the inner blade of the short hair cutting blade block 1*a* through an associating portion (not shown). If the drive element 8 reciprocates in the X direction as described above, the movable blade for cutting long hair reciprocates in the X direction, and long hair introduced from the slit holes of the slit blade is cut.

As shown in FIGS. 3 to 5, if the Y direction is defined as the longitudinal direction, the shaver main body 9 which becomes a grip to be grasped by a user is provided at its front surface with an operation switch 35 for turning the motor 11 ON and OFF. If the X direction is defined as the lateral direction, a side front opening 36 shown in FIG. 5 is formed in a front portion of an upper portion of one of left and right sides (i.e., both side surfaces in the X direction). Of the drive element bases 19 arranged in the longitudinal direction which is the Y direction from the side front opening 36, when a portion of the front side drive element base 19 is slid in the X direction (leftward or rightward), the portion of the drive element base 19 can project outward from the side front opening 36. Although it is not shown in the drawings, side rear opening (not shown) is formed in a rear portion of an upper portion of the other side surface of the left and right side surfaces of the shaver main body 9. When a portion of the rear drive element base 19 of the drive element bases 19 arranged in the longitudinal direction which is the Y direction from the side rear opening slides in the X direction (rightward or leftward), the portion of the drive element base 19 can project outward from the side rear opening. When the X direction is the lateral direction and the Y direction is the longitudinal direction, the X direction intersects with both the Y direction which is the Y direction and the vertical direction at right angles, and the Y direction intersects with both the X direction which is the lateral direction and the vertical direction at right angles.

The shaver main body 9 which becomes the grip becomes a surface where a thumb is located when the front surface side on which the operation switch 35 is provided is grasped by a hand. Normally, in a state where the shaver main body 9 is grasped by the hand, the operation switch 35 provided on the front surface is operated by the thumb located on the front surface. When the shaver is used, a user grasps the shaver main body 9 such that the thumb is located on the side of the front surface and in this state, the blade block 1 is brought into contact with a skin of the user, and the shaver is moved such that the side thereof on which the thumb is located comes front in the advancing direction. Therefore, of the Y direction which is the longitudinal direction, the Y1 direction is a using direction of the shaver 4 (moving direction of the shaver 4 when the shaver is used) (see FIG. 5).

The long hair cutting blade block 1*b* of each of the short hair cutting blade block 1*a* and the long hair cutting blade block 1*b* arranged on each of the outer blade frames 2 in the Y direction is closer to the front side as compared with the short hair cutting blade block 1*a* with respect to the using direction (Y1 direction) of the shaver 4.

According to the shaver 4 of the present invention having the above-described structure, when hair in a portion of a human body having a narrow shaving width such as an armpit is to be cut, as shown in FIG. 4, and the shaver is used in a state where the plurality of outer blade frames 2 arranged in the Y direction are located in the initial positions. In the initial position, the plurality of outer blade frames 2 are arranged in the Y direction without deviating in the X direction, the plurality of drive element bases 19 (frame mounting stages 29 fitted over the drive element bases 19) are arranged in the Y direction without deviating in the X direction as shown in FIGS. 10 and 11, and the lock member 33 is resiliently engaged with one of the retaining units 32, and the drive element base 19 is fixed in the initial position. In the initial position, as shown in FIG. 12, the drive gears 6 provided on the drive element bases 19 located on both sides (longitudinally both sides) are engaged with the central output side main gear 5*a* in the X direction (lateral direction) of the three output side gears 5, rotation of the motor is transmitted to each drive gear 6 through the central output side main gear 5*a*. The movable blade of each blade block 1 provided on each outer blade frame 2 is reciprocated to cut hair on a portion of the shaving area such as the armpit. The state where the plurality of outer blade frames 2 arranged in the Y direction are located in the initial position is the using mode in which the shaving area width M where the hair can be shaved at a time by the entire blade blocks 1 provided on the outer blade frames 2 is the narrowest (shortest), and the hair in the narrow shaving area such as the armpit can effectively be cut.

In a state where the outer blade frames 2 are located in the initial position, hair is shaved by the short hair cutting blade block 1*a* and the long hair cutting blade block 1*b* arranged on each outer blade frame 2. If the shaver 4 is moved in the Y1 direction which is the using direction in a state where the short hair cutting blade block 1*a* and the long hair cutting blade block 1*b* provided on each the outer blade frame 2 are pushed against a skin, long hair is cut short by the long hair cutting blade block 1*b* located in front of the front outer blade frame 2 and then, the short hair is cut by the short hair cutting blade block 1*a* located in the rear of the front outer blade frame 2 and then, not yet been cut hair by the front outer blade frame 2 is cut by the front long hair cutting blade block 1*b* in font of the rear outer blade frame 2 and then, this short hair is cut by the short hair cutting blade block 1*a* located behind the rear outer blade frame 2, and hair in the narrow shaving area such as the armpit is effectively cut in many stages.

Next, when a wide portion such as a leg or an arm is to be shaved, the outer blade frame 2 is slid in the X direction, the outer blade frame 2 is deviated in the X direction as shown in FIG. 3, the shaving area width M that can be shaved at a time by the entire blade block 1 is elongated and used. The lock member 33 resiliently engages other retaining unit 32 that is different from the initial position of the retaining units 32, and the drive element base 19 is fixed to the initial position. Therefore when the shaving area width M that can be shaved at a time is elongated and used, the shaving area width M can be used in a state where the shaving area width M is held at a predetermined length.

In a state where the outer blade frame 2 is slid in the X direction and the shaving area width M is elongated, as shown in FIG. 8, the drive gear 6 provided on one of the drive element bases 19 located on both sides (longitudinally both sides) in the Y direction is engaged with one of the output side gears 5 on the both sides in the X direction (lateral direction) of the three output side gears 5 (i.e., one of the left and right output side auxiliary gears 5*b* and 5*b*) as shown in FIG. 8, the drive gear 6 provided on the other drive element base 19 is engaged with the other one of the output side gears 5 on the both sides in the X direction (lateral direction) of the three output side gears 5 (i.e., other one of the left and right output side auxiliary gears 5*b* and 5*b*), rotation of the motor is transmitted to the drive gears 6 through the left and right output side auxiliary gears 5*b* and 5*b*, the movable blades of the blade blocks 1 provided on the outer blade frames 2 are reciprocated to cut hair on a narrow shaving area such as an armpit.

If the shaving area width M is elongated and used in this manner, the amount of hair which can be shaved with one stroke is increased and the shaving operation can be carried out quickly. Even when the outer blade frame 2 is slid in the X direction and the shaving area width M is elongated and hair is cut, since the outer blade frames 2 are respectively provided with the long hair cutting blade block 1*b* and the short hair cutting blade block 1*a* and the long hair cutting blade block 1*b* is located in front of the short hair cutting blade block 1*a* with respect to the using direction of the shaver 4, if the shaver 4 is moved in the Y1 direction which is the using direction in a state where the short hair cutting blade block 1*a* and the long hair cutting blade block 1*b* provided on the outer blade frames 2 are pushed against a skin, long hair is cut by the long hair cutting blade block 1*b* located in front of the outer blade frame 2, the shortly cut hair is cut short by the short hair cutting blade block 1*a* located in the rear of the outer blade frame 2 and thus, hair can be cut in two stages by the long hair cutting blade block 1*b* and the short hair cutting blade block 1*a* over the entire shaving area width M, and the cutting operation can be carried out effectively.

Here, in the embodiment shown in the accompanying drawings, the front and rear two outer blade frames 2 are slid in different directions from each other (one of the outer blade frames 2 is slid in the forward and the other one is slid in rightward). With this the shaving area width M that can be shaved at a time efficiently can be elongated (long), the amount of hair that can be shaved with one stroke is increased, and the shaving operation can be carried out quickly.

If both the outer blade frames 2 can slide in the X direction and both the outer blade frames 2 are slid in different directions to widen the shaving area width M that can be shaved at a time and only one of the outer blade frames 2 is slid, the shaving area width M can have an intermediate length of the shaving area width M shown in FIG. 3 and the shaving area width M shown in FIG. 4.

Although the two outer blade frames 2 can move in the X direction in the embodiment, it is only necessary that at least one of the plurality of outer blade frames 2 arranged in the Y direction can slide, and of the plurality of outer blade frames 2, an outer blade frame 2 which does not slide and an outer blade frame 2 which slides can be arranged in the Y direction.

When the outer blade frame 2 is slid in the X direction, a user may pinch the outer blade frame 2 itself with fingers and slide the same, or a sliding operation mechanism for sliding the outer blade frame 2 may be provided, and the outer blade frame 2 may be slid in the X direction by operating a slide operating unit provided on the shaver main body 9.

Next, an embodiment shown in FIGS. 13 to 36 will be explained.

As shown in FIGS. 13 to 16, a shaver 4 of the embodiment includes a shaver main body 9 which is a grip to be griped by a hand of a user, and a plurality of outer blade frames 2 provided on an upper portion of the shaver main body 9. The outer blade frames 2 hold a blade block 1 for cutting hair. The outer blade frames 2 are arranged in a direction intersecting with a moving direction X of a movable blade of the blade block 1. The moving direction of the movable blade 39 is defined as X direction (lateral direction), and the arrangement direction of the outer blade frames 2 intersecting with the X direction is defined as Y direction (longitudinal direction). A direction intersecting with both the X direction and Y direction at right angles is defined as a vertical direction, a side of the shaver main body 9 closer to the blade block 1 is defined upside, and the opposite side is defined downside.

Figure 13:
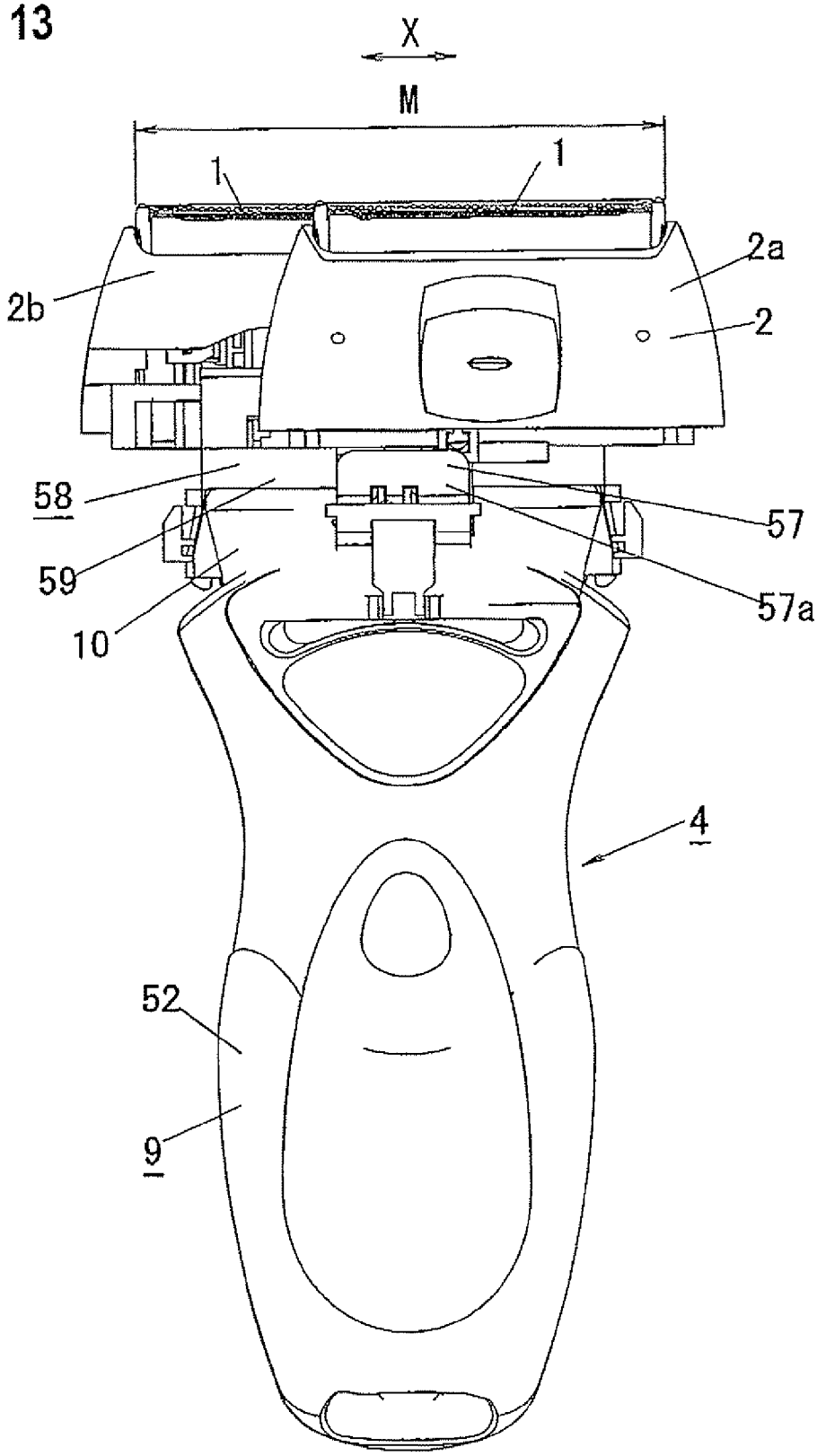
FIG. 13 is a front view when an outer blade frame of a shaver of another embodiment of the present invention is slid and a shaving area width is elongated.
Figure 14:
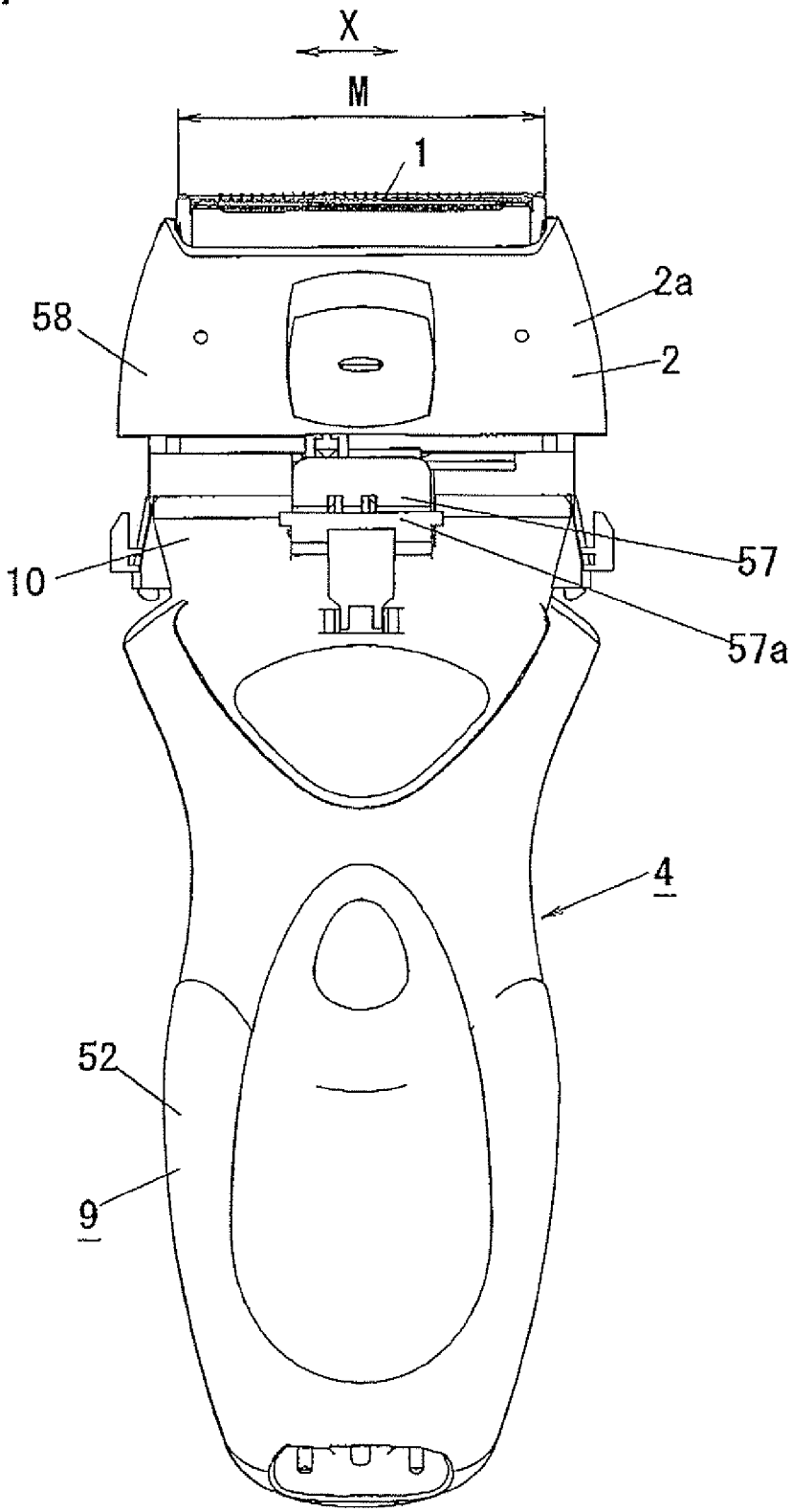
FIG. 14 is a front view when the outer blade frame of the shaver is located at the initial position and the shaving area width is short.
Figure 15:
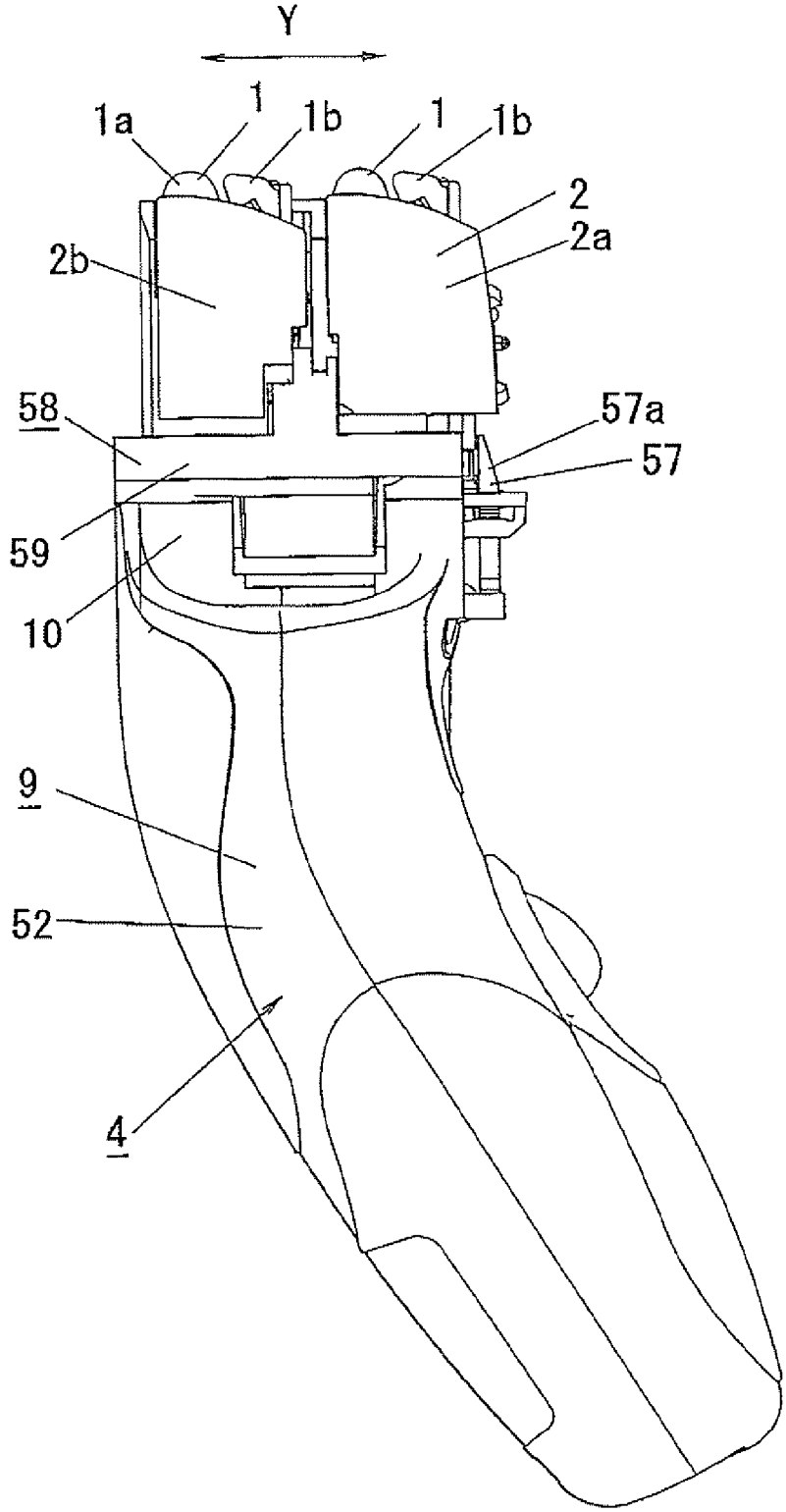
FIG. 15 is a side view of the shaver.

In the following embodiments also, explanation of usage and effect in a state where outer blade frames 2 are slid in the X direction and the shaving area width M is elongated as shown in FIG. 13, and explanation of usage and effect in a state where the shaving area width M is elongated as shown in FIG. 14 are the same as those of the previous embodiment. Therefore, explanation concerning this point will be omitted from the following embodiment and concrete mechanisms will be explained below.

The shaver main body 9 has a housing 52 as a main body, and an upper base 10 is mounted on an upper portion of the housing 52.

Figure 17:
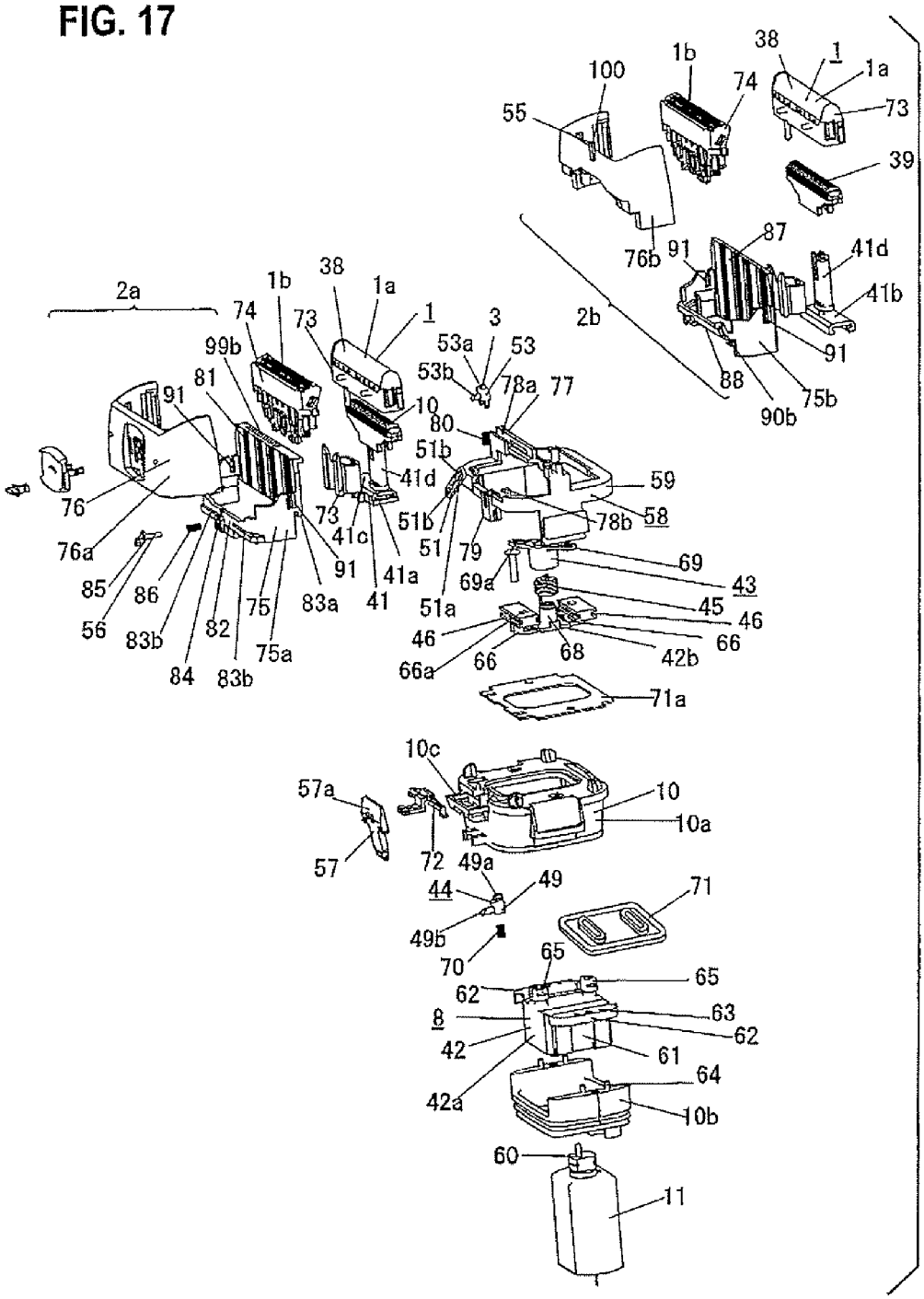
FIG. 17 is an exploded perspective view of a state where a housing is omitted.
Figure 27:
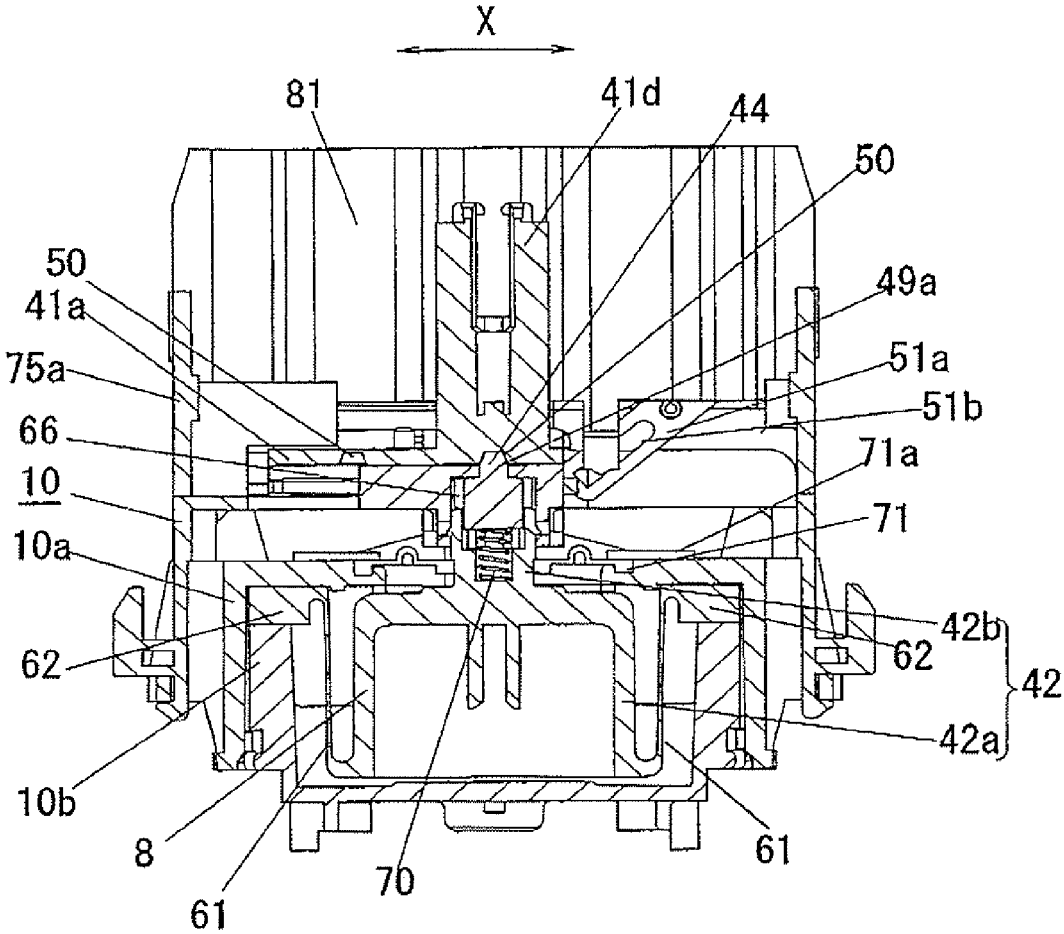
FIG. 27 is a front sectional view of a drive element connecting unit.

In the present embodiment, as shown in FIG. 17, an upper base 10 includes a blade mounting stage 10*a* and a drive element base 10*b*. A motor 11 which is a drive source is mounted on the drive element base 10*b*. An eccentric cam 60 having an eccentric tip end is press fitted into a motor shaft end. The tip end of the eccentric cam 60 is fitted into a slit formed in the drive element 5. The drive element 8 is provided at its left and right both ends with U-shaped hinge pieces 61 which can be deformed only in one direction. If the drive element base 10*b* is fitted into the blade mounting stage 10*a* and mounted in a state where a projection 64 provided on the drive element base 10*b* is fitted into a hole 63 formed in the mount piece 62 on the tip end of the hinge piece 61, the mount piece 62 is sandwiched between the blade mounting stage 10*a* and the drive element base 10*b* and mounted as shown in FIG. 27, and the drive element 8 reciprocates by rotation of the motor 11 through an eccentric cam 60.

As shown in FIGS. 17 and 36, the drive element 8 is divided into a drive source-side drive element portion 42 on the side of the motor 11 which is the drive source and a movable blade-side drive element portion 41 on the side of the movable blade 39. As will be described later, the movable blade-side drive element portion 41 is mounted such that it can slide in the X direction (lateral direction) which is a reciprocating direction of the movable blade 39 with respect to the drive source-side drive element portion 42.

In the embodiment shown in the accompanying drawings, the drive source-side drive element portion 42 is further divided into a main drive element portion 42*a* and an auxiliary drive element portion 42*b* fixed to the main drive element portion 42*a*. The main drive element portion 42*a* is provided at its left and right both sides with the hinge pieces 61, and two fitting projections 65 are provided on both front and rear sides (in the direction intersecting with the reciprocating direction of the drive element 8 at right angles) of an upper surface of the main drive element portion 42*a*. Two fitting holes 66 are formed in both front and rear sides of a lower surface of the auxiliary drive element portion 42*b* If the fitting projection 65 is fitted into the fitting hole 66, the auxiliary drive element portion 42*b* is fixed to the main drive element portion 42*a*. Rails (recesses 46 in the embodiment shown in FIG. 17) are provided on front and rear portions of an upper surface of the auxiliary drive element portion 42*b*, the rails are long in the lateral direction, and a projecting shaft portion 68 upwardly projects from a central portion of the auxiliary drive element portion 42*b*. A central cylindrical portion of a drive element lever 69 is rotatably fitted to the projecting shaft portion 68, the drive element lever 69 constitutes a drive element associating unit 43, and the drive element lever 69 applies a spring force which tries to turn the drive element lever 69 in one direction by a spring member 45 including a coil spring.

Figure 16:
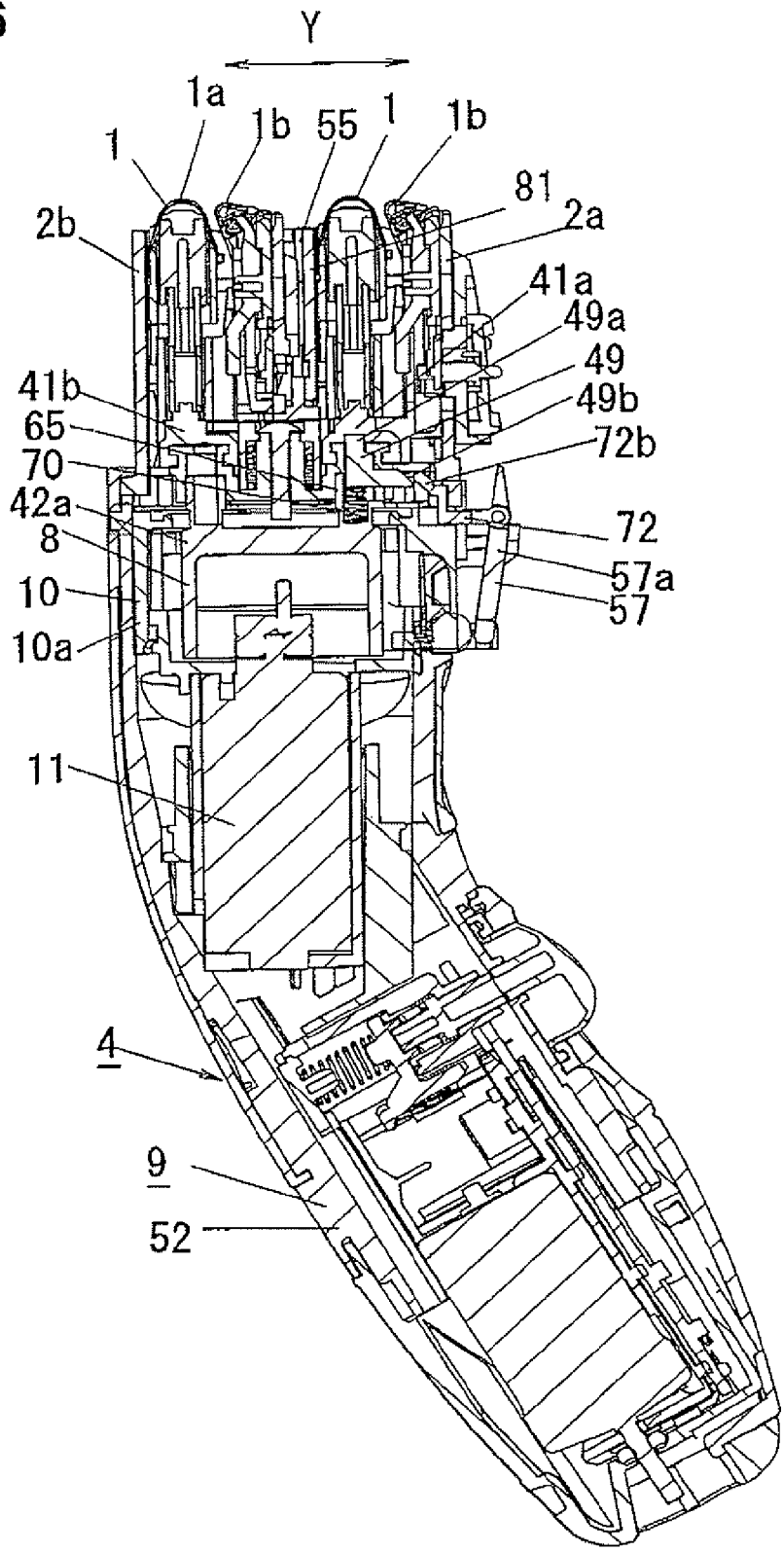
FIG. 16 is a side sectional view of the shaver.

As shown in FIGS. 16 and 17, one of the fitting projections 65 of the main drive element portion 42*a* is of a cylindrical shape, an upper portion thereof is opened, a drive element lock member 49 and a spring 70 are accommodated in the fitting projection 65 for applying a spring force to resiliently bias the drive element lock member 49, an upper portion of the drive element lock member 49 is vertically movably fitted into a fitting hole 66 formed in the auxiliary drive element portion 42*b*, and a locking projection 49*a* projecting upward from an upper surface of the drive element lock member 49 projects upward from a hole 66*a* formed in an upper surface of the auxiliary drive element portion 42*b* such that the locking projection 49*a* can expand and contract. Both side surfaces of the locking projection 49*a* in the lateral direction are inclined and the locking projection 49*a* is tapered toward its tip end. The drive element lock member 49 has a projection having an inclined surface 49*b*. A lower portion of the inclined surface 49*b* projects more forward.

Figure 35:
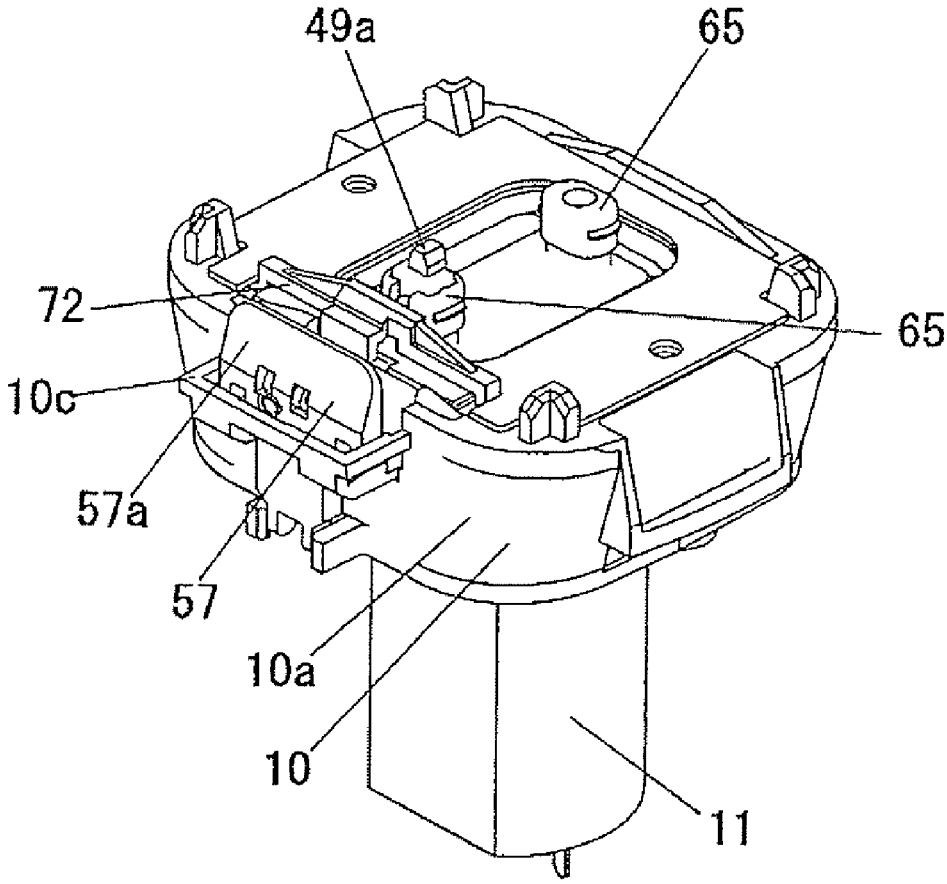
FIG. 35 is a perspective view of a state where a drive source-side drive element portion is mounted on an upper base.

As shown in FIG. 35, a portion of the drive source-side drive element portion 42 which is higher than the fitting projection 65 of the main drive element portion 42*a* projects from the opening formed in the upper surface of the blade mounting stage 10*a*. As shown in FIG. 27, a waterproof rubber plate 71 is mounted on the upper surface of the blade mounting stage 10*a*, the waterproof rubber plate 71 can deform such as to close the opening, a lower portion of the fitting projection 65 of the main drive element portion 42*a* is fitted into a hole formed in the waterproof rubber plate 71 so that a hole edge of the waterproof rubber plate 71 comes into close contact with the fitting projection 65 resiliently, thereby preventing hair shavings and water from entering the shaver main body 9. The waterproof rubber plate 71 is sandwiched between the press plate 71*a* and the blade mounting stage 10*a* by mounting the press plate 71*a* on the upper surface of the blade mounting stage 10*a*.

Figure 36A:
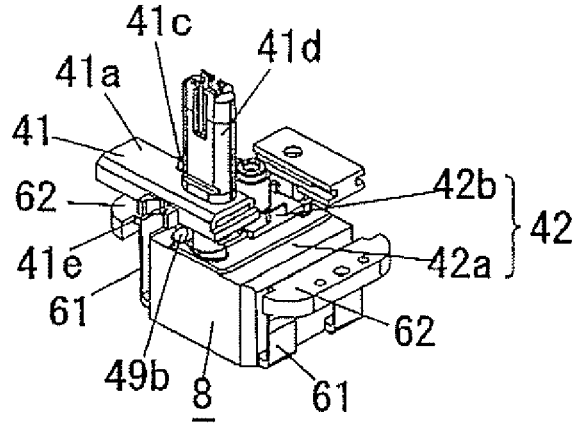
FIG. 36A is a partially omitted perspective view of a drive element.
Figure 36B:
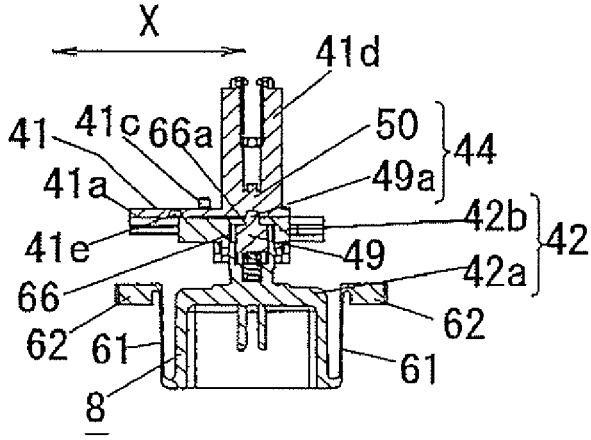
FIG. 36B is a sectional view.
Figure 36C:
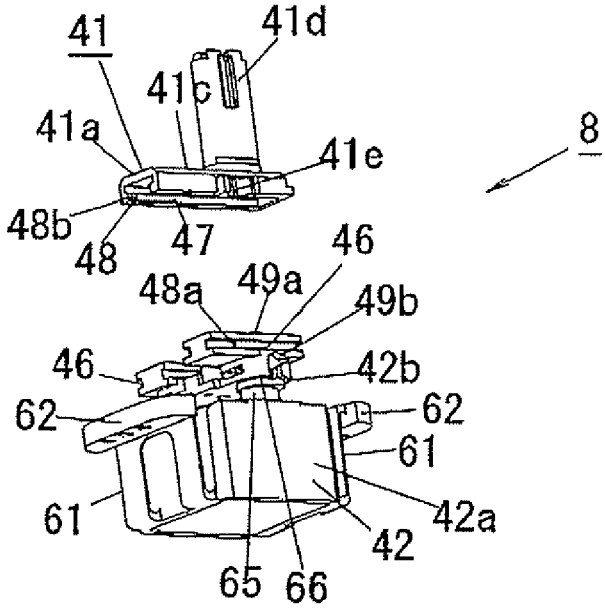
FIG. 36C is an exploded perspective view.

A movable blade-side drive element portion 41 (front movable-side drive element portion 41*a* and rear movable element-side drive element portion 41*b*) is mounted on front and rear portions of the auxiliary drive element portion 42*b* of the drive source-side drive element portion 42 such that the movable blade-side drive element portion 41 can slide in the X direction (lateral direction). In the embodiment shown in the accompanying drawings, as shown in FIGS. 36A to 36C, a laterally long protrusion 47 provided on the movable blade-side drive element portion 41 is slidably mounted by a rail structure which is slidably fitted in a laterally long recess 46 formed in the auxiliary drive element portion 42*b* and as shown in FIG. 36C, a stopper step 48*a* is provided on an end of the rail structure, i.e., an end of the recess 46 which becomes a rail, a stopper 48 constituted by projecting a stopper projection 48*b* from an end of a protrusion 47, and when the protrusion 47 and the recess 46 slide laterally, it the stopper projection 48*b* abuts against the stopper step 48*a*, the stopper projection 48*b* cannot slide further, and this position is a target slide-stop position.

As shown in FIG. 27, two lock holes 50 into which the locking projections 49*a* projecting from an upper surface of the drive element lock member 49 biased by the spring are formed in the lower surface of the front movable-side drive element portion 41*a* in a sliding direction (X direction), the drive element lock member 49 having the locking projection 49*a* biased by this spring and the lock holes 50 constitute a drive element connecting unit 44 which connects the front movable-side drive element portion 41*a* to the drive source-side drive element portion 42 at the initial position and the sliding position, and by fitting the locking projection 49*a* into one of the two lock holes 50 corresponding to the initial position, the front movable-side drive element portion 41*a* is connected and fixed to the drive source-side drive element portion 42 at the initial position, and by fitting the locking projection 49*a* into the lock hole 50 corresponding to the sliding position, the front movable-side drive element portion 41*a* is connected and fixed to the drive source-side drive element portion 42 at the sliding position.

As shown in FIG. 27, left and right inner surfaces of the lock hole 50 are inclined such that a lateral width is inclined downward, the locking projection 49*a* which is tapered toward its tip end is fitted into and locked to the lock hole 50 which whose lateral width is increased downward and thus, if a force greater than a given value is applied in the sliding direction, the locked state is unlocked.

Figure 22:
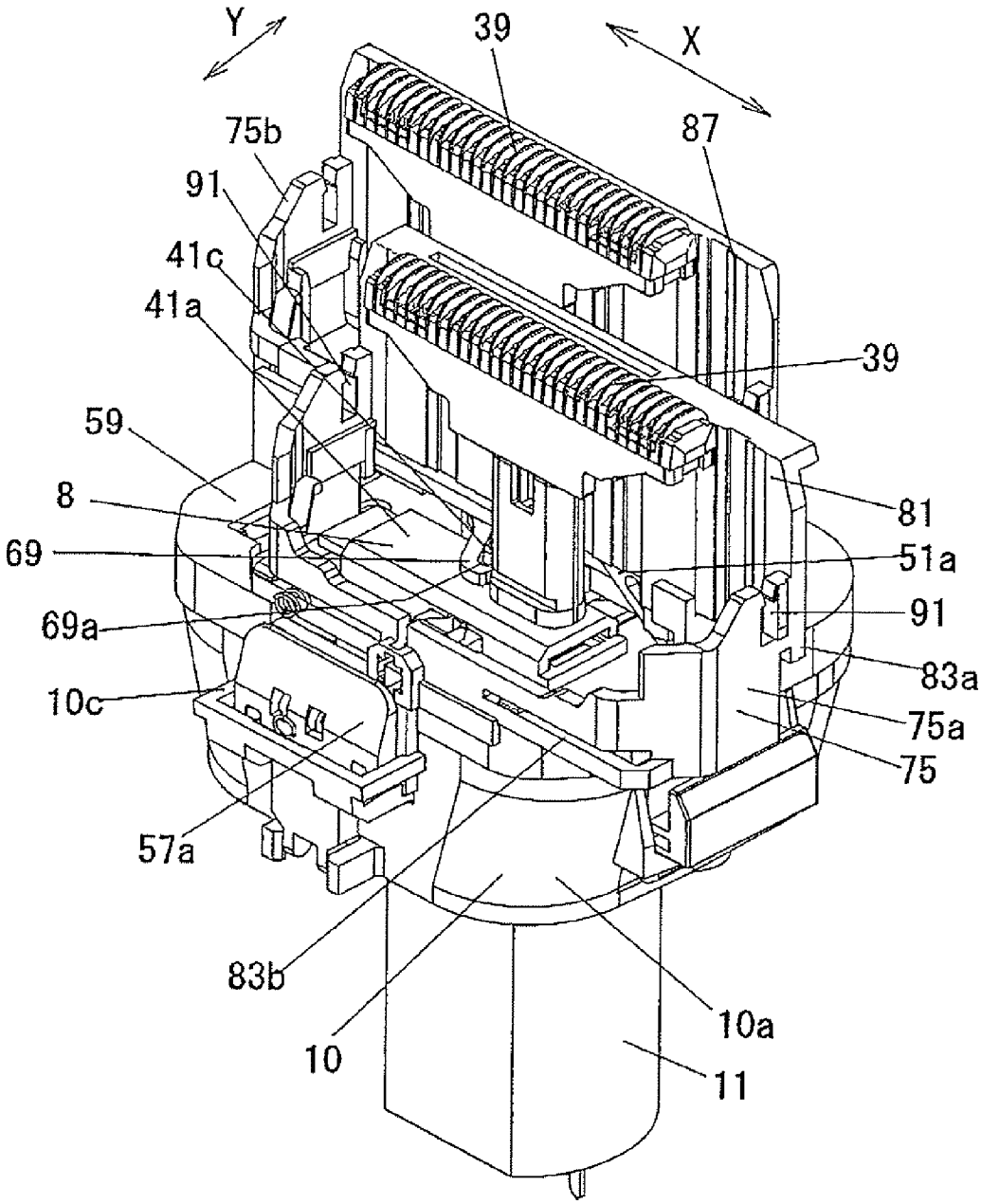
FIG. 22 is a perspective view in a state where front and rear frame portions in FIG. 18 are omitted.
Figure 23:
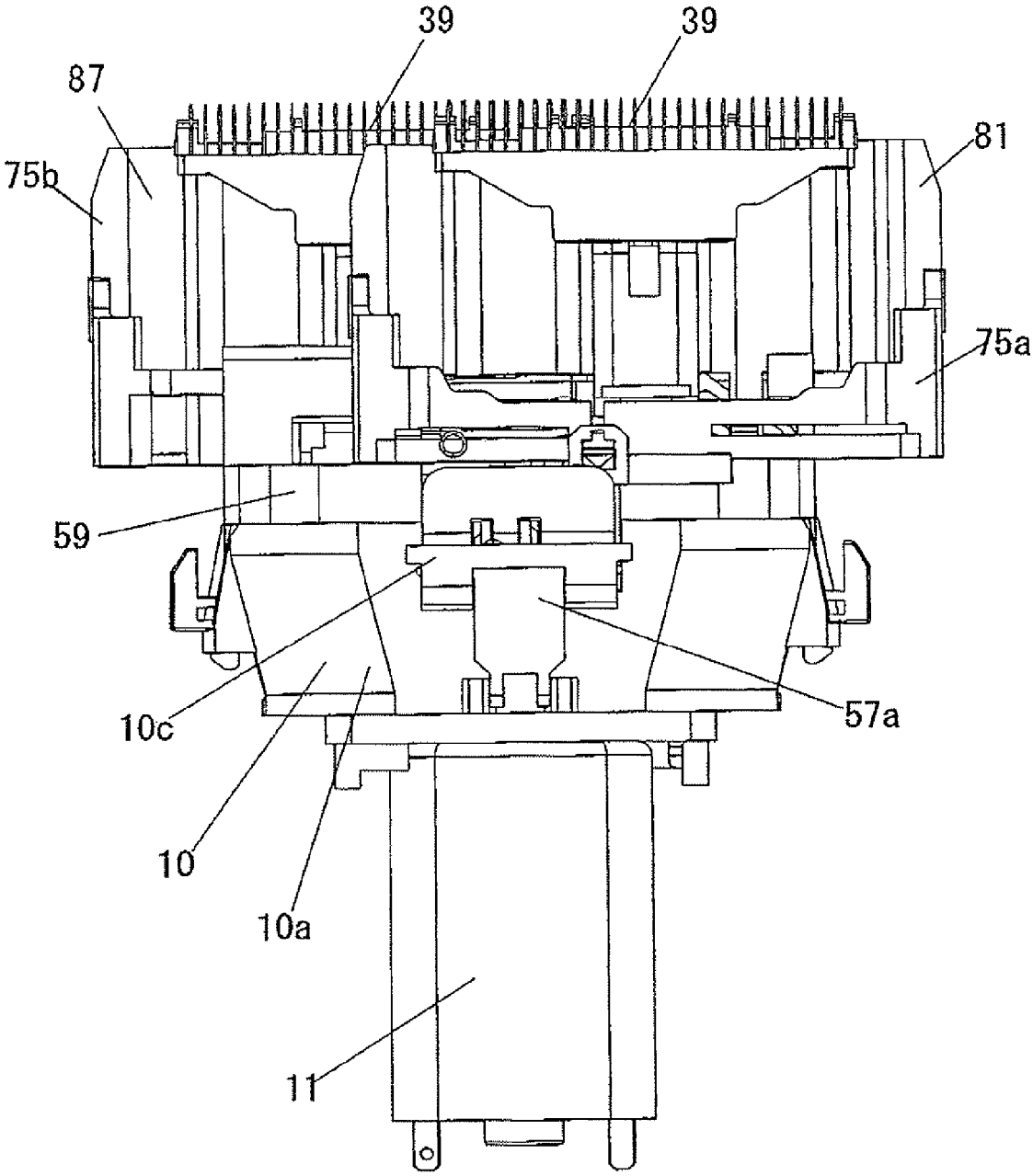
FIG. 23 is a front view in a state where front and rear frame portions in FIG. 19 are omitted.
Figure 24:
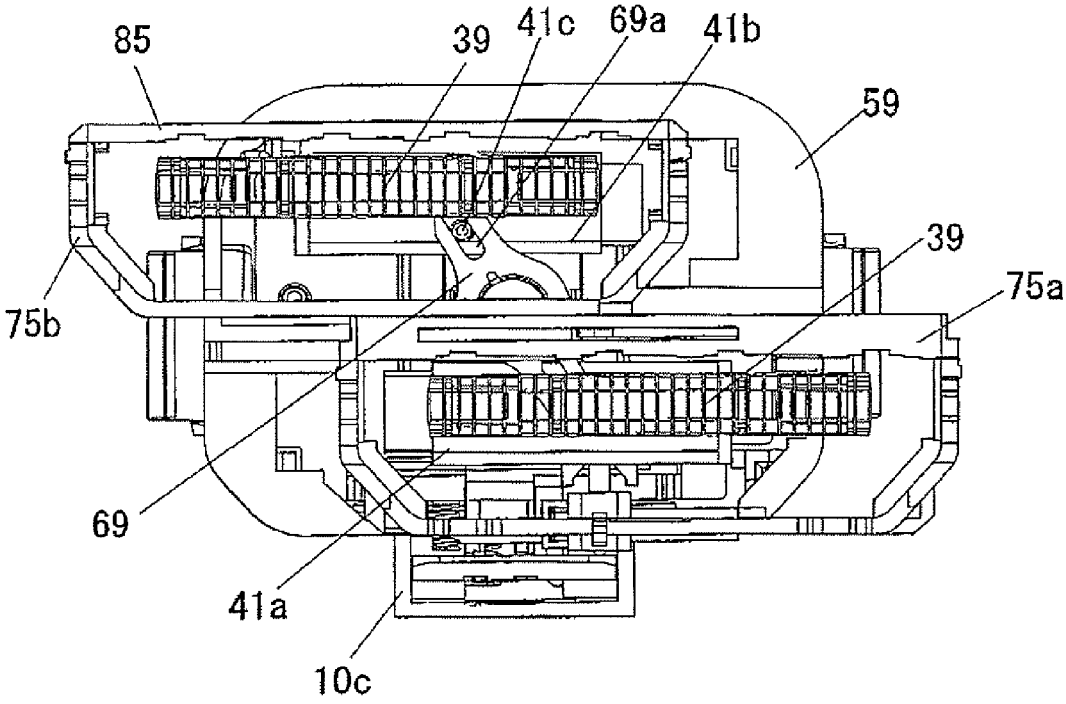
FIG. 24 is a plan view in a state where front and rear frame portions in FIG. 20 are omitted.
Figure 25:
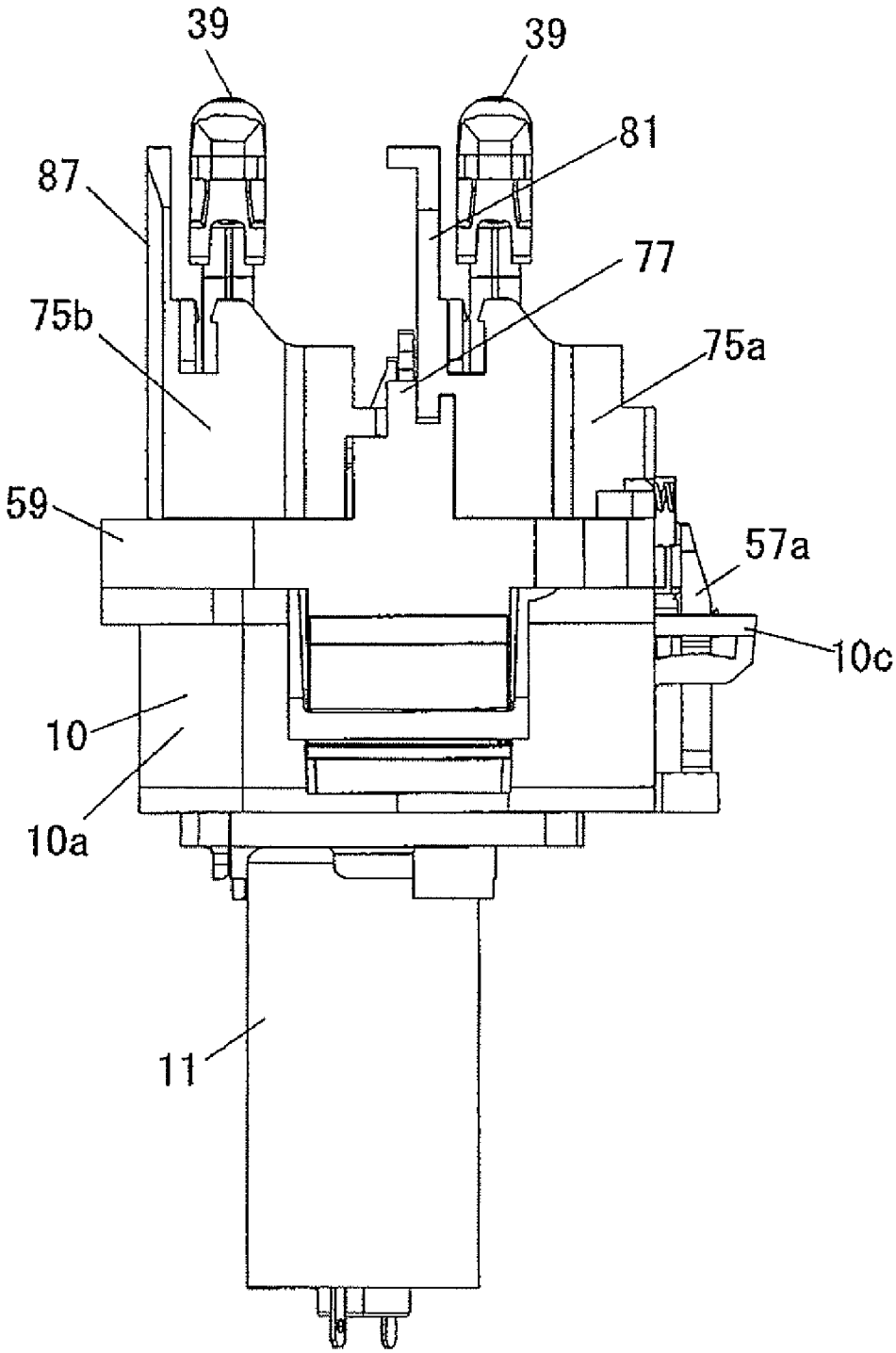
FIG. 25 is a side view in a state where front and rear frame portions in FIG. 21 are omitted.
Figure 30:
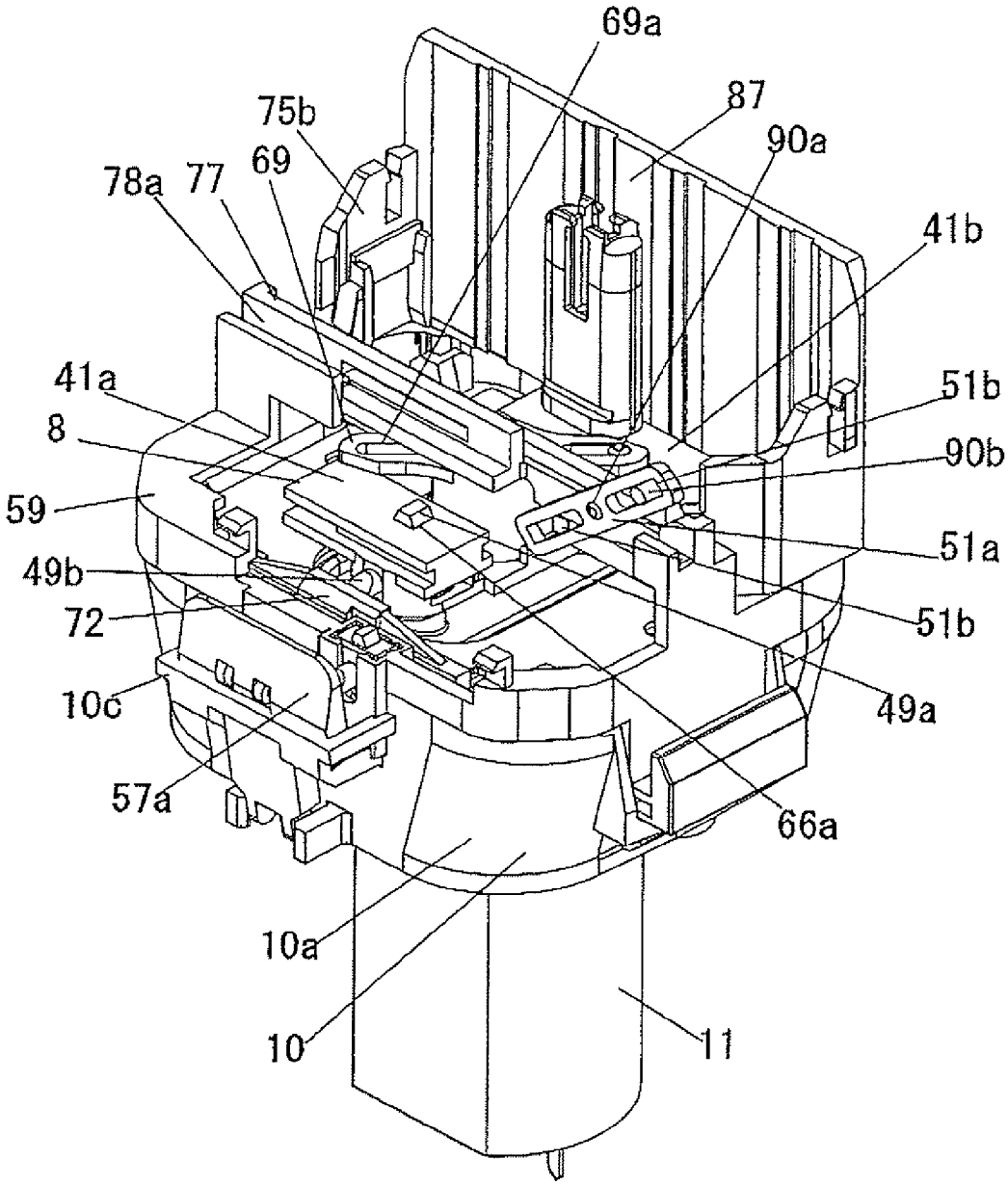
FIG. 30 a is a perspective view of a state where the front movable blade-side drive element portion in FIG. 26 is omitted.

As shown in FIGS. 17, 22, and 30, the drive element lever 69 is provided at its opposite ends with long holes 69*a*, a projecting shaft portion 41*c* provided on an upper surf ace portion of the front movable-side drive element portion 41*a* is slidably fitted into one of the long holes 69*a*, another projecting shaft portion 41*c* provided on an upper surf ace portion of the rear movable element-side drive element portion 41*b* is slidably fitted into the other long hole 69*a*, and if the fitting state of the locking projection 49*a* into the lock hole 50 is released in the initial position and the front movable-side drive element portion 41*a* slides from the initial position to the sliding position (the left sliding position in the drawings), since the projecting shaft portion 41*c* is slidably fitted into the long hole 69*a*, the drive element lever 69 turns in one direction, the drive element lever 69 turns, the rear movable element-side drive element portion 41*b* slides from the initial position to the sliding position (the right sliding position) in association, and if the fitting state of the locking projection 49*a* in the lock hole 50 is released in the sliding position and the front movable-side drive element portion 41*a* slides from the sliding position (the left sliding position in the drawing) to the initial position, since the projecting shaft portion 41*c* is slidably fitted into the long hole 69*a*, the drive element lever 69 turns in a direction opposite from the above direction, the drive element lever 65 turns, the rear movable element-side drive element portion 41*b* slides from the sliding position (the right sliding position) to the initial position in association.

Here, a spring force which tries to turn the drive element lever 69 in one direction by the spring member 45 is applied and thus, if the spring member 45 applies a spring force which tries to turn the drive element lever 69 from the initial position to the sliding position, the front movable-side drive element portion 41*a* slides to the sliding position automatically and the rear movable element-side drive element portion 41*b* slides to the sliding position in association by releasing the locking projection 49*a* into the lock hole 50 in the initial position.

When the spring member 45 applies a spring force which tires to turn from the sliding position to the initial position, the front movable-side drive element portion 41*a* slides to the initial position automatically and the rear movable element-side drive element portion 41*b* slides to the initial position in association by releasing the locking projection 49*a* into the lock hole 50 at the sliding position.

In the front and rear movable blade-side drive element portion 41*a* and movable blade-side drive element portion 41*b* are superposed in the longitudinal direction when the movable blade 39 supported by the movable blade-side drive element portion 41*a* and the movable blade 39 supported by the movable blade-side drive element portion 41*b* substantially correspond in the lateral direction and when they are seen from front.

Figure 26:
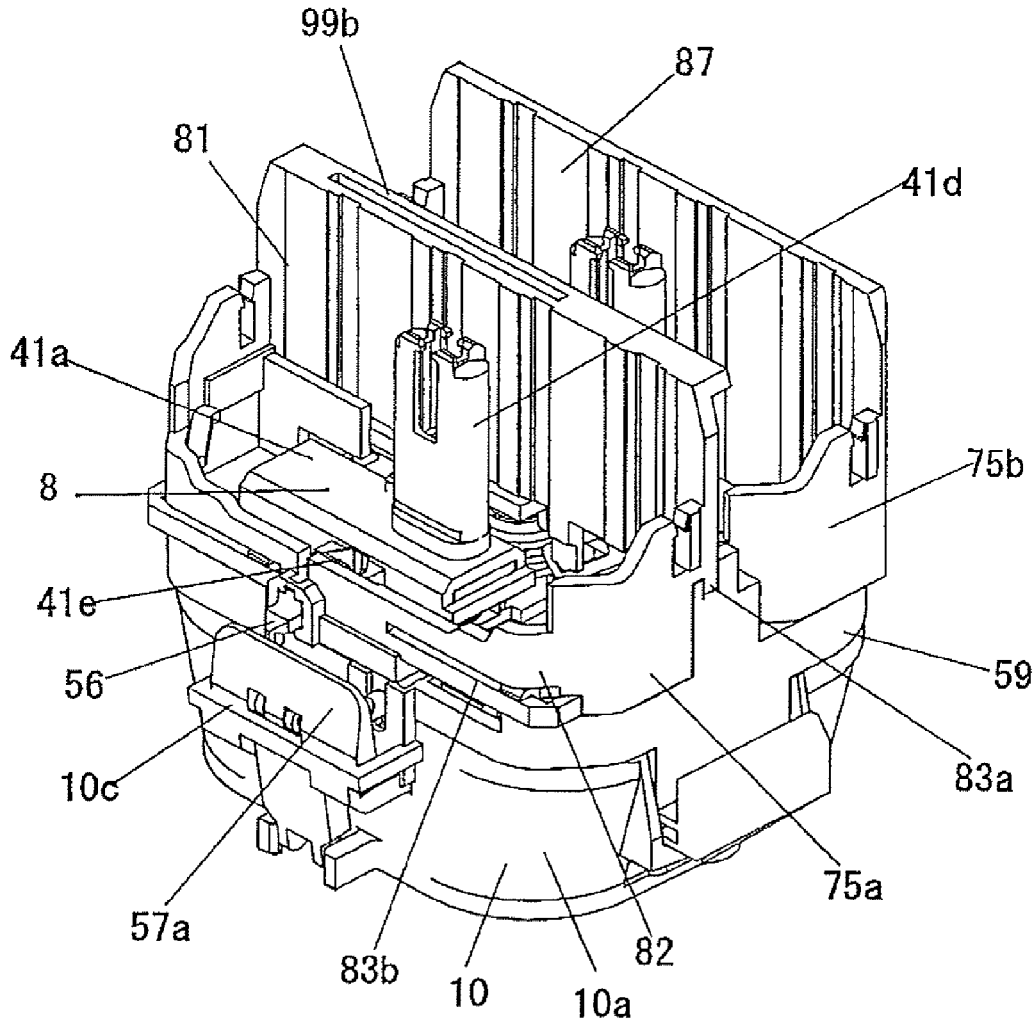
FIG. 26 is a perspective view in a state where front and rear frame portions in FIG. 22 are omitted.
Figure 29:
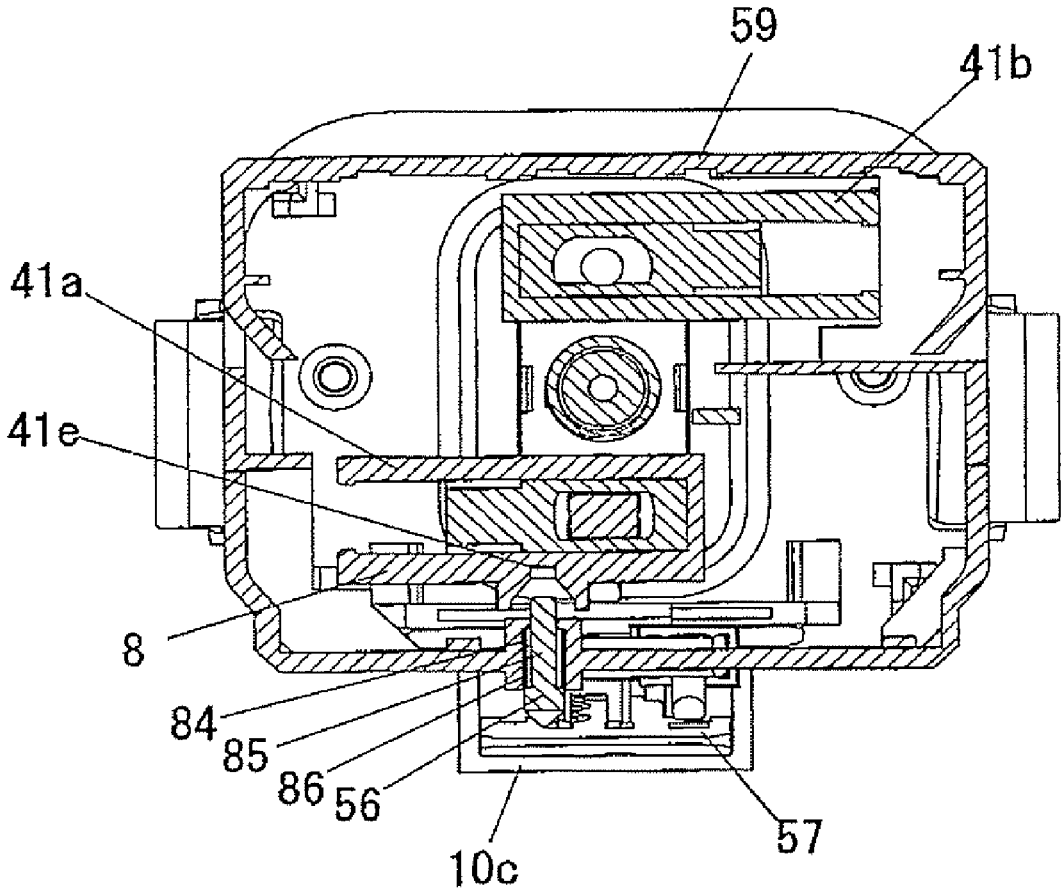
FIG. 29 is a plan sectional view of a connecting member portion.

As shown in FIGS. 17 and 26, movable blade mounting portions 41*d* upwardly project from the front and rear movable blade-side drive element portion 41*a* and movable blade-side drive element portion 41*b*. The front movable-side drive element portion 41*a* is provided at its front surface with a connection hole 41*e*, and a front portion of the connection hole 41*e* has a lateral hole width which is increased forward as shown in FIG. 29.

Figure 34A:
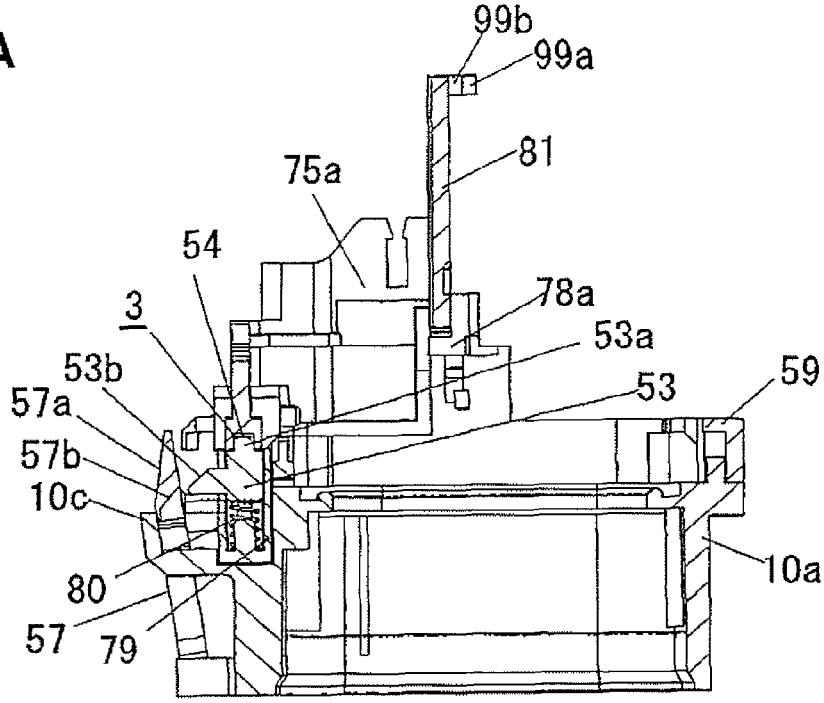
FIG. 34A is a sectional view of a positional relationship between a drive element lock member and an operation button.
Figure 34B:
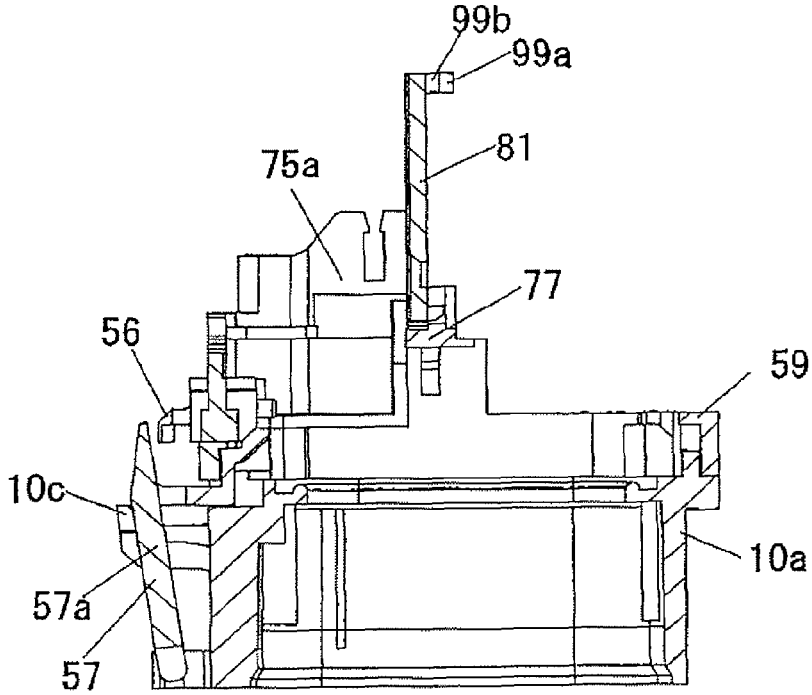
FIG. 34B is a sectional view of a positional relationship between a connecting member and the operation button.

As shown in FIGS. 16, 34, and 35, an operation button 57*a* constituting an operating unit 57 is mounted on a front surface side of the blade mounting stage 10*a*. The operation button 57*a* is turnably supported by the bearing portion 10*d* provided on a front surface lower portion of the blade mounting stage 10*a*, and an upper portion of the operation button 57*a* is inserted into a support frame portion 10*c* formed on a front surface upper portion of the blade mounting stage 10*a* such that the upper portion of the operation button 57*a* cam move in the longitudinal direction. A slide lever 72 is mounted on the blade mounting stage 10*a* such that the slide lever 72 can slide in the longitudinal direction, a front end of the slide lever 72 is fitted into a vertically long hole formed in the operation button 57*a*, the slide lever 72 is provided at its rear end surface with an inclined surface 72*b* which is inclined into an upper and rear direction, the inclined surface 72*b* and an inclined surface 49*b* of the locking projection 49*a* are opposed to each other as shown in FIG. 16, and if the operation button 57*a* is pushed and operated rearward, the inclined surface 72*b* of the slide lever 72 moves rearward along the inclined surface 49*b* of the locking projection 49*a*, the locking projection 49*a* moves downward against the spring 70, and the locking projection 49*a* enters into the hole 66*a* formed in the upper surface of the auxiliary drive element portion 42*b*. If the pushing operation of the operation button 57*a* is released, the drive element lock member 49 moves upward by the spring force of the spring 70, and if the inclined surface 49*b* pushes, the slide lever 72 moves forward, and the operation button 57*a* turns forward in the support frame portion 10*c*.

As shown in FIG. 34A, the operation button 57*a* is provided at its rear surface with an inclined surface 57*b* which is inclined in an upper and rear direction for operating a later-described frame lock member 53.

A blade head 58 is detachably mounted on the blade mounting stage 10*a*. The blade head 58 includes a frame base 59, the outer blade frames 2 mounted on the main frame base 59 in the longitudinal direction (the Y direction intersecting with the X direction which is the reciprocating direction of the movable blade 39), and the blade blocks 1 provided on the respective outer blade frames 2 for cutting hair.

At least one of the outer blade frames 2 arranged in the longitudinal direction is mounted on the main frame base 59 such that the outer blade frame 2 can slide in the moving direction of the movable blade 39 from the initial position, and in the embodiment shown in the accompanying drawings, two outer blade frames 2 can slide in different directions (an outer blade frame 2 which slides and an outer blade frame 2 which does not slide can be arranged in the longitudinal direction of course).

Each of the outer blade frames 2 includes the blade block 1. In the present embodiment, an outer blade block 73 and a trimmer block 74 are trimmed on an upper portion of the outer blade frame 2, and the movable blade 39 mounted on the movable blade mounting portion 41*d* through the spring provided on the movable blade-side drive element portion 41 is disposed in the outer blade frame 2.

As the outer blade frames 2, there exist a front outer blade frame 2*a* and a rear outer blade frame 2*b*. Each of the outer blade frames 2 includes a frame main body portion 75 and a cover frame portion 76. That is, the front outer blade frame 2*a* includes a frame main body portion 75*a* and a cover frame portion 76*a*, and a rear outer blade frame 2*b* includes a frame main body portion 75*b* and a cover frame portion 76*b*.

Figure 18:
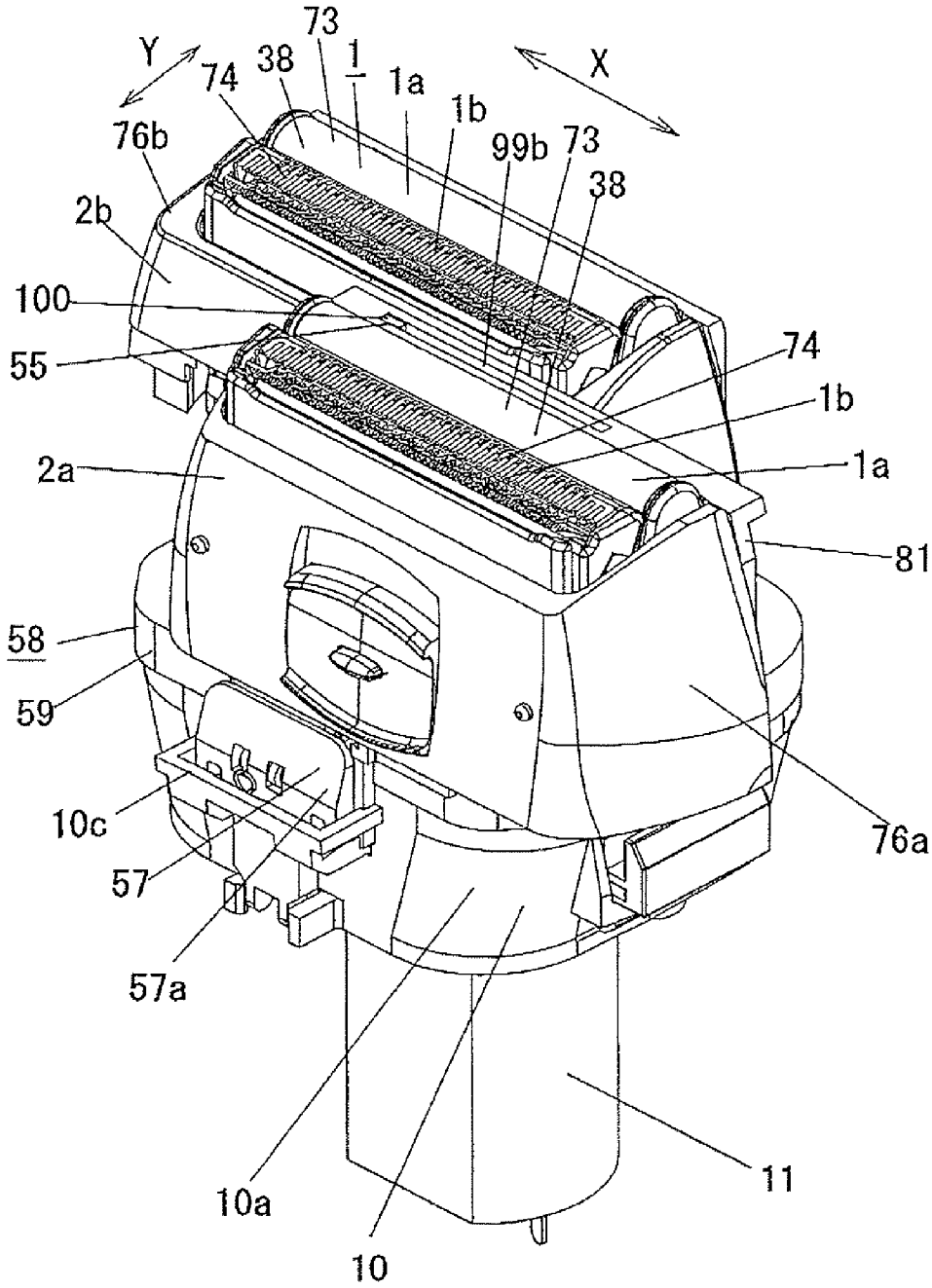
FIG. 18 is a perspective view when the outer blade frame of the shaver is slid and the shaving area width is elongated in a state where the housing is omitted.
Figure 19:
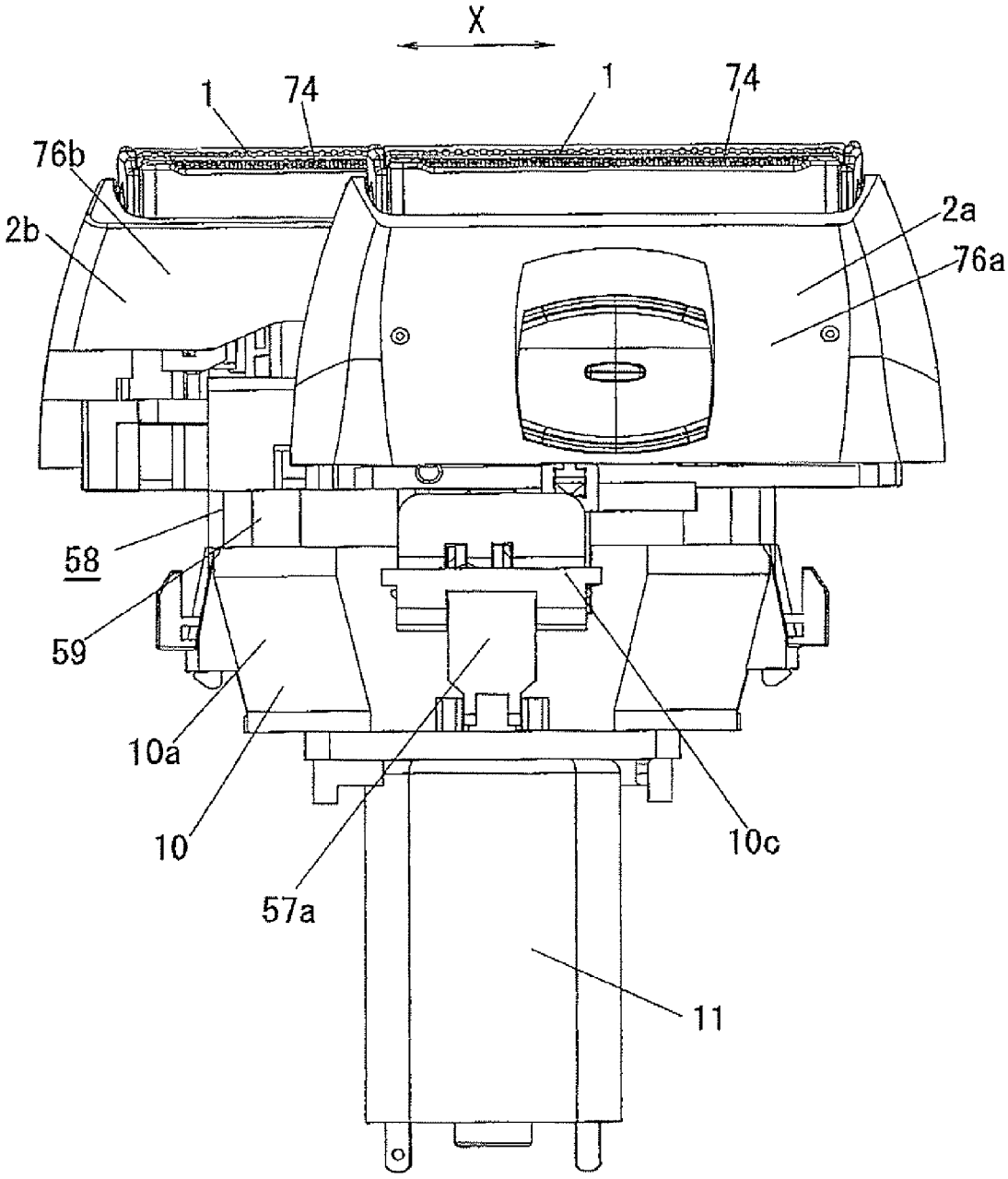
FIG. 19 is a front view when the outer blade frame of the shaver is slid and the shaving area width is elongated in a state where the housing is omitted.
Figure 20:
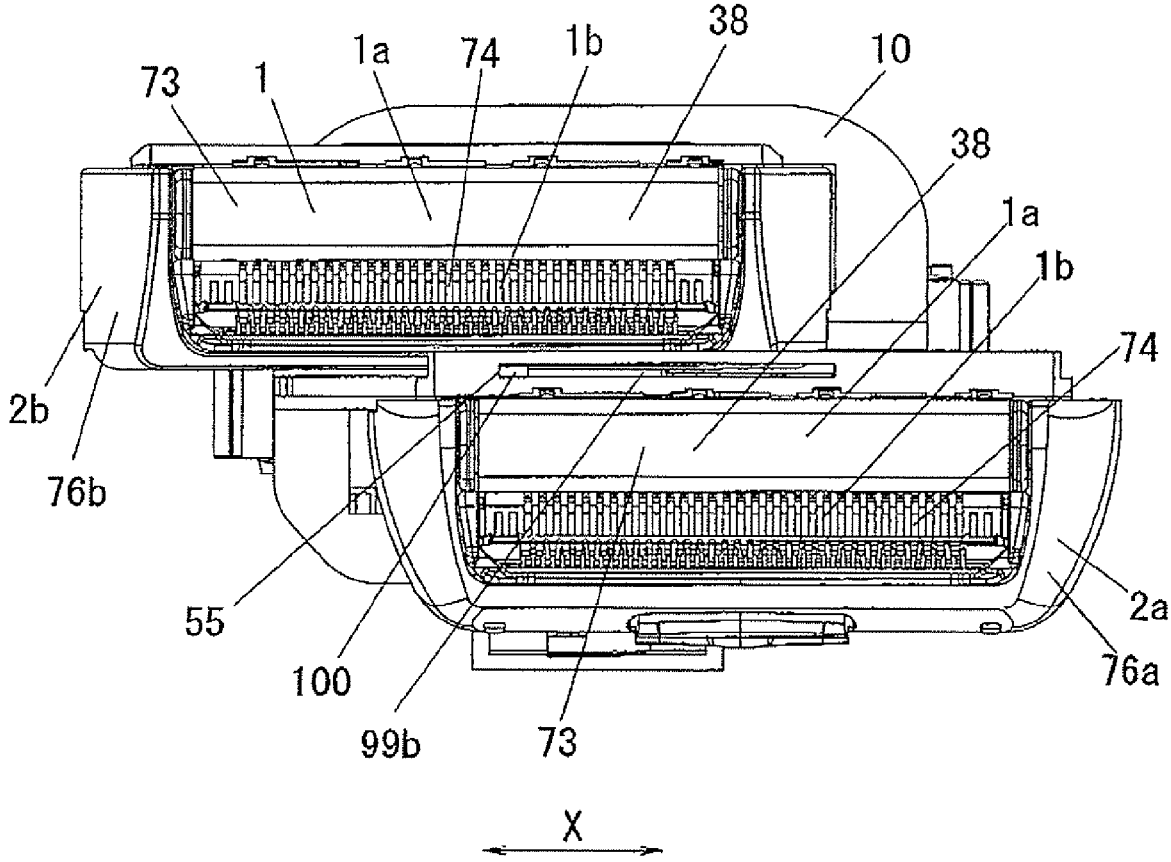
FIG. 20 is a plan view when the outer blade frame of the shaver is slid and the shaving area width is elongated in a state where the housing is omitted.
Figure 21:
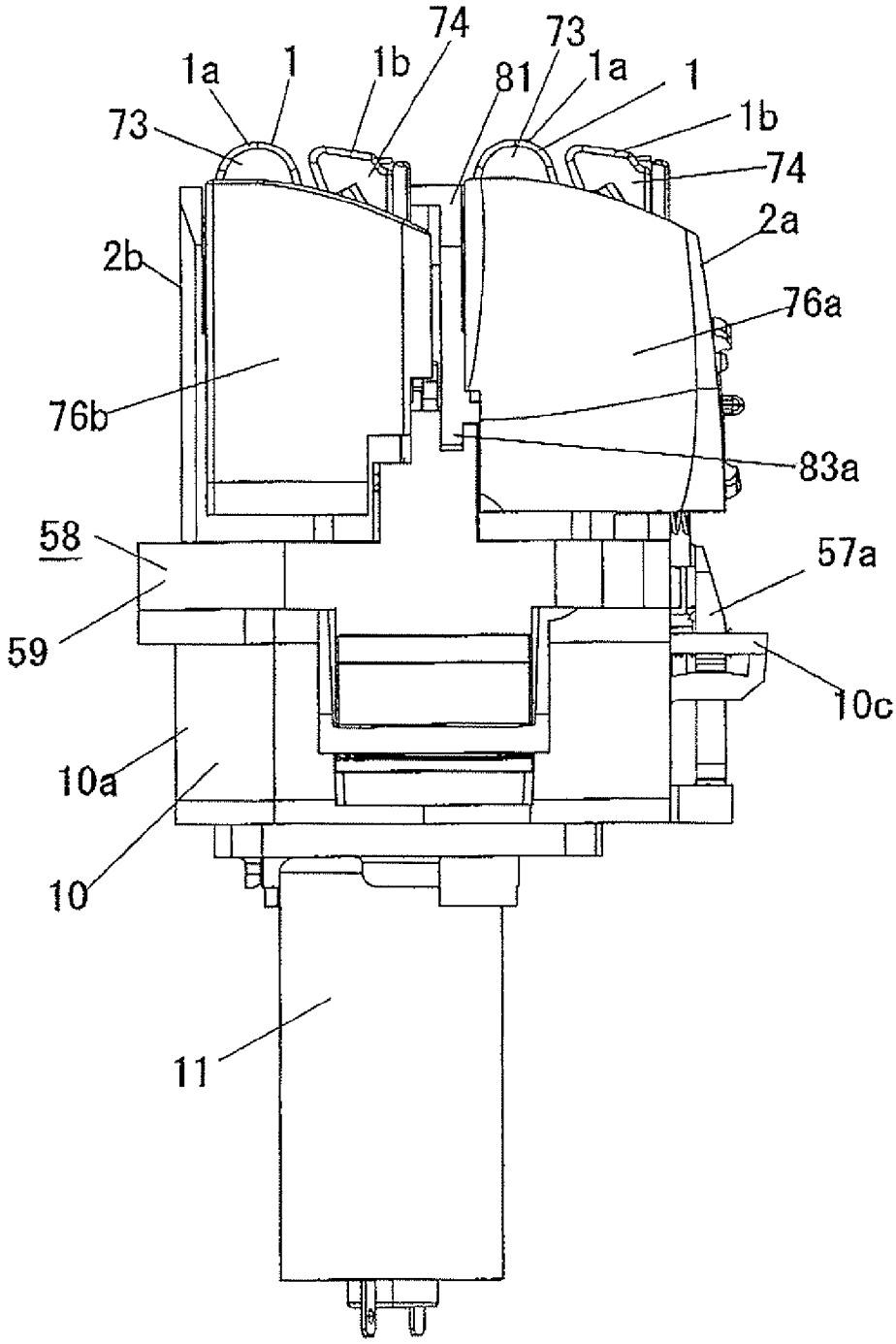
FIG. 21 is a side view in a state where the housing is omitted.

As shown in FIG. 22, the front and rear frame main body portions 75*a* and 75*b* are provided at their left and right sides with slit-like notch portions 91, and rib portions (not shown) provided on front and rear frame portions 76*a* and 7*b* are vertically movably mounted on the slit-like notch portions 91 (see FIGS. 18 to 20). The outer blade block 73 and the trimmer block 74 are respectively mounted on the front and rear frame portions 76*a* and 76*b*.

The outer blade block 73 is provided with a net blade which is an outer blade 38, and if the outer blade 38 reciprocates in a state where the movable blade 39 mounted on the movable blade-side drive element portion 41 through a spring is pushed against a back surface (a lower surface) of the outer blade 38, the outer blade 38 and the movable blade 39 cut hair. The outer blade 38 and the movable blade 39 constitute the short hair cutting blade block 1*a*.

The trimmer block 74 constituting the long hair cutting blade block 1*b* is vertically movably mounted on a front cover frame port ion 76*a* and the rear outer blade frame 2*b*. The trimmer block 74 includes a slit blade which is an outer blade, and an inner blade which is resiliently pushed against a lower surface of the slit blade by a spring material, the inner blade is detachably connected to the front movable-side drive element portion 41*a* and a connection portion 93 provided on the rear movable element-side drive element portion 41*b*, and if the front movable-side drive element portion 41*a* and the rear movable element-side drive element portion 41*b* reciprocate, the inner blade of the trimmer block 74 also reciprocates.

In the embodiment shown in the accompanying drawings, the front outer blade frame 2*a* and the rear outer blade frame 2*b* are mounted on the main frame base 59 such that they can slide in the lateral direction X (moving direction of the movable blade 39).

The main frame base 59 is of a square frame shape, and as shown in FIG. 17, the main frame base 59 is provided with a central bridging piece 77 which bridges longitudinal central portions in the lateral direction, a rail portion 78*a* whose upper portion is opened is provided on substantially half (left side in the embodiment) in the lateral direction of a front side of the central bridging piece 77, a slide projection 78*b* which is of reversed L-shape in the lateral direction upwardly projects from a front upper surface of the square frame shaped main frame base 59, a slide projection 78*c* is provided on one side (right side in the embodiment) of a rear surface of the central bridging piece 77 as shown in FIG. 33, a slide rail portion 78*d* is provided on one side (left side in the embodiment) of the rear surface in the lateral direction, and a rear slide rail portion 78*e* is provided on a rear portion of the square frame-shaped main frame base 59. Further, a cylindrical portion 79 is provided on a central portion of a front portion of the square frame-shaped main frame base 59 in the lateral direction. As shown in FIG. 30, an association lever 51*a* constituting an outer blade frame associating unit 51 is mounted on other side half portion (right side in the embodiment) on which a rail portion 78*a* of the central bridging piece 77 is not provided such that a central portion of the association lever 51*a* can turn on a vertical plane. The association lever 51*a* is formed at its both ends with long holes 51*b*.

Figure 28:
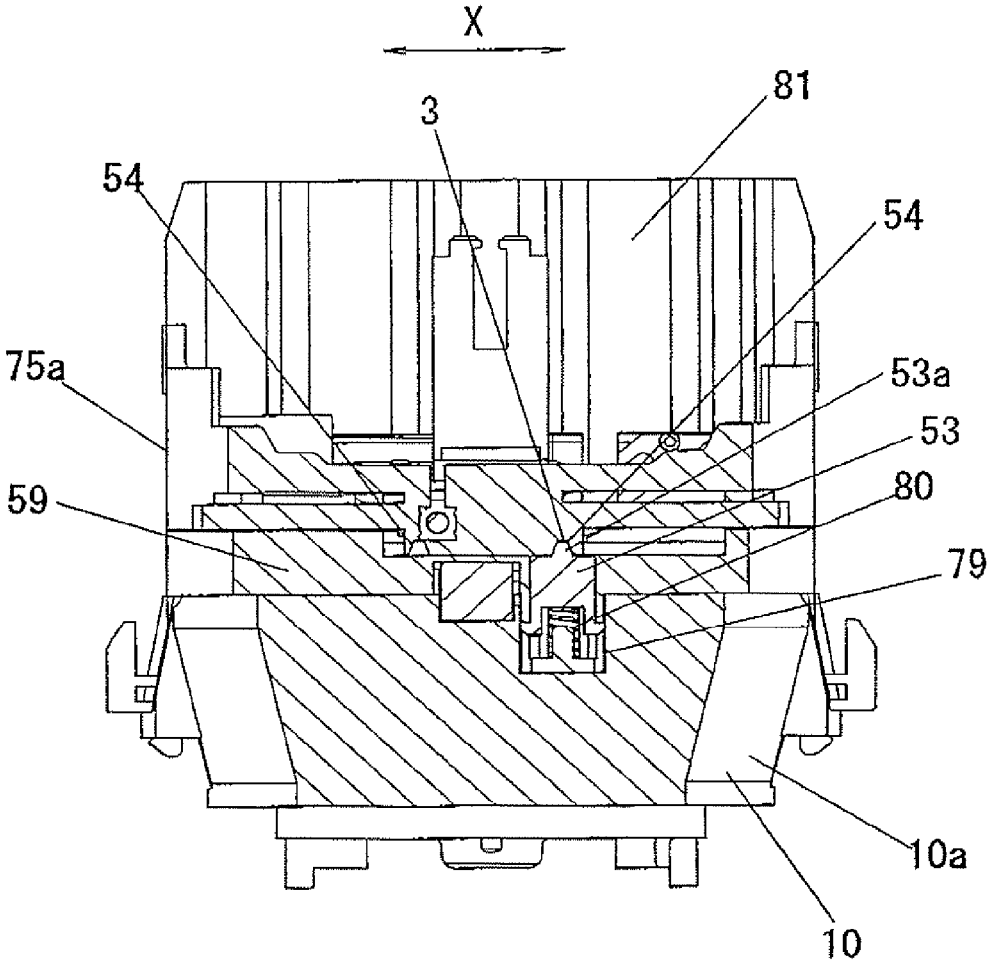
FIG. 28 is a front sectional view of a fixing unit for fixing the outer blade frame.

As shown in FIG. 28, a frame lock member 53 and a spring 80 for resiliently biasing the frame lock member 53 upward are accommodated in the cylindrical portion 79, and an upper portion of the frame lock member 53 can project from an upper opening of the cylindrical portion 79. A locking projection 53*a* projects upward from an upper surface of the frame lock member 53, and both side surfaces of the locking projection 53*a* in the lateral direction are inclined and tapered toward their tip end. A projection having am inclined surface 53*b* projects from the frame lock member 53, the inclined surface 53*b* is inclined into a lower and front direction, and the projection projects forward from a vertical slit formed in a front surface of the cylindrical portion 73.

As shown in FIG. 34A, the inclined surface 53*b* provided on the frame lock member 53 is opposed to the inclined surface 57*b* provided on a rear surface of the operation button 57*a*, and it the operation button 57*a* is pushed rearward, the inclined surface 57*b* moves rearward to push the inclined surface 53*b* downward, and the frame lock member 53 is moved downward. If the pushing operation of the operation button 57*a* is released, the frame lock member 53 moves upward by a spring force of the spring 80, the inclined surface 53*b* moves upward, the inclined surface 57*b* is pushed forward, and the operation button 57*a* moves forward.

The front outer blade frame 2*a* is constituted by mounting the cover frame portion 76*a* on the frame main body portion 75*a*.

Figure 32:
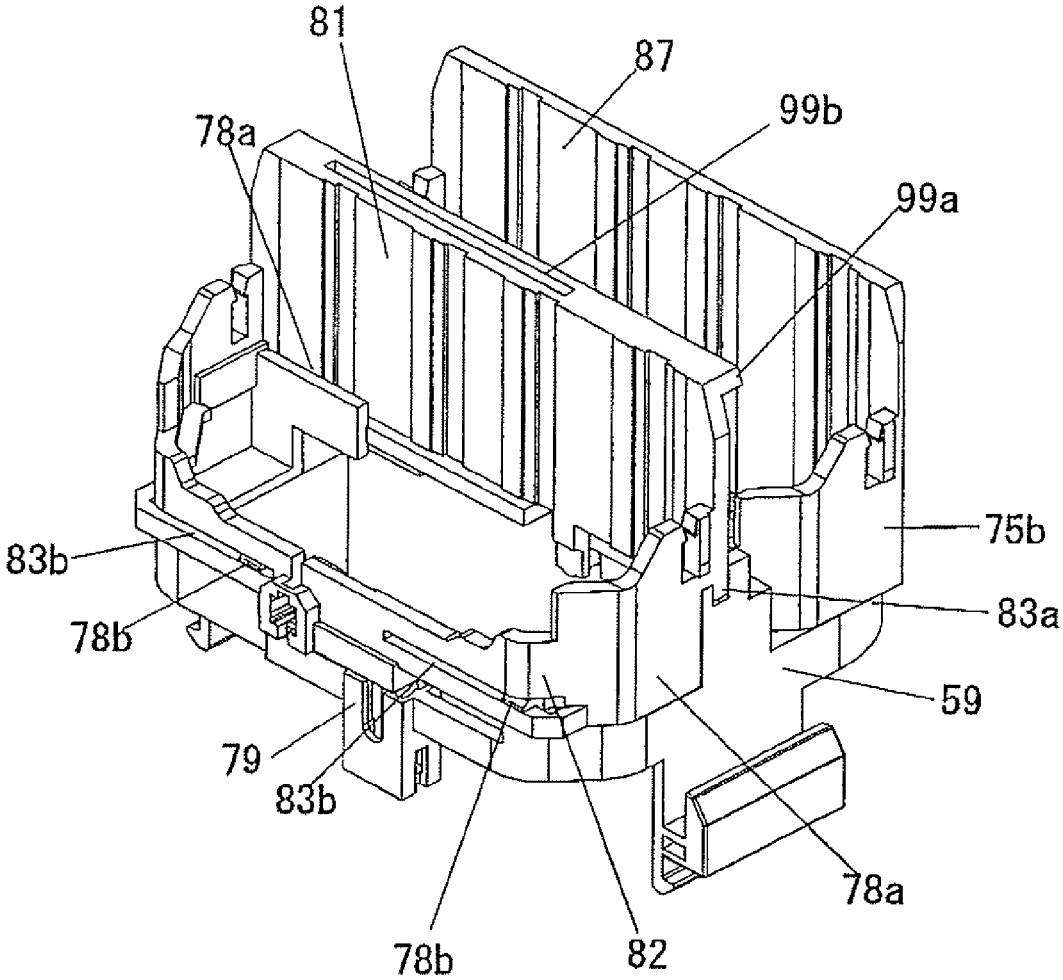
FIG. 32 is a perspective view of a state where the front frame main body port ion and the rear frame main body portion are slidably mounted on the frame base.

As shown in FIGS. 17, 26, and 32, the frame main body portion 75*a* integrally provided with a U-shaped frame portion 82 which projects forward from a lower end of a vertical front wall plate portion 81. A lower end of the front wall plate portion 81 projects below a portion to which the frame portion 82 of the front wall plate portion 81 is connected, and this portion is a rail fitting portion 83*a*. Rail portions 83*b* which are long in the lateral direction are provided on left and right portions of a front portion of the frame portion 82. Further, as shown in FIGS. 17 and 29, a hole portion 84 is formed in a central portion of a front portion of the frame portion 82 in the lateral direction, a rear portion of the connection pin 85 and a spring 86 for applying a spring force which tries to project the connection pin 85 forward are inserted into the hole portion 84, the rear end of the connection pin 85 is in the hole portion 84 by the spring 86 in a normal state, but if the connection pin 85 is pushed rearward against the spring 86, the rear end can project rearward from the hole portion 84, and when it projects rearward, the rear end of the connection pin as can be fitted into the connection hole 41*e*. The connection pin 85, the spring 86 and the connection hole 41*e* constitute the connecting member 56 which is detachably connect the movable blade-side drive element portion 41 and the outer blade frame 2 to the outer blade frame 2. As shown in FIG. 28, locking holes 54 to which locking projections 53 projecting from upper surface of the frame lock member 53 biased by the spring are formed in two locations of a front lower surface of the frame portion 82 in the lateral direction (sliding direction). The two locking holes 54 in the lateral direction have the same pitches as those of the two lock holes 50 formed in the movable blade-side drive element portion 41*a*.

Figure 31:
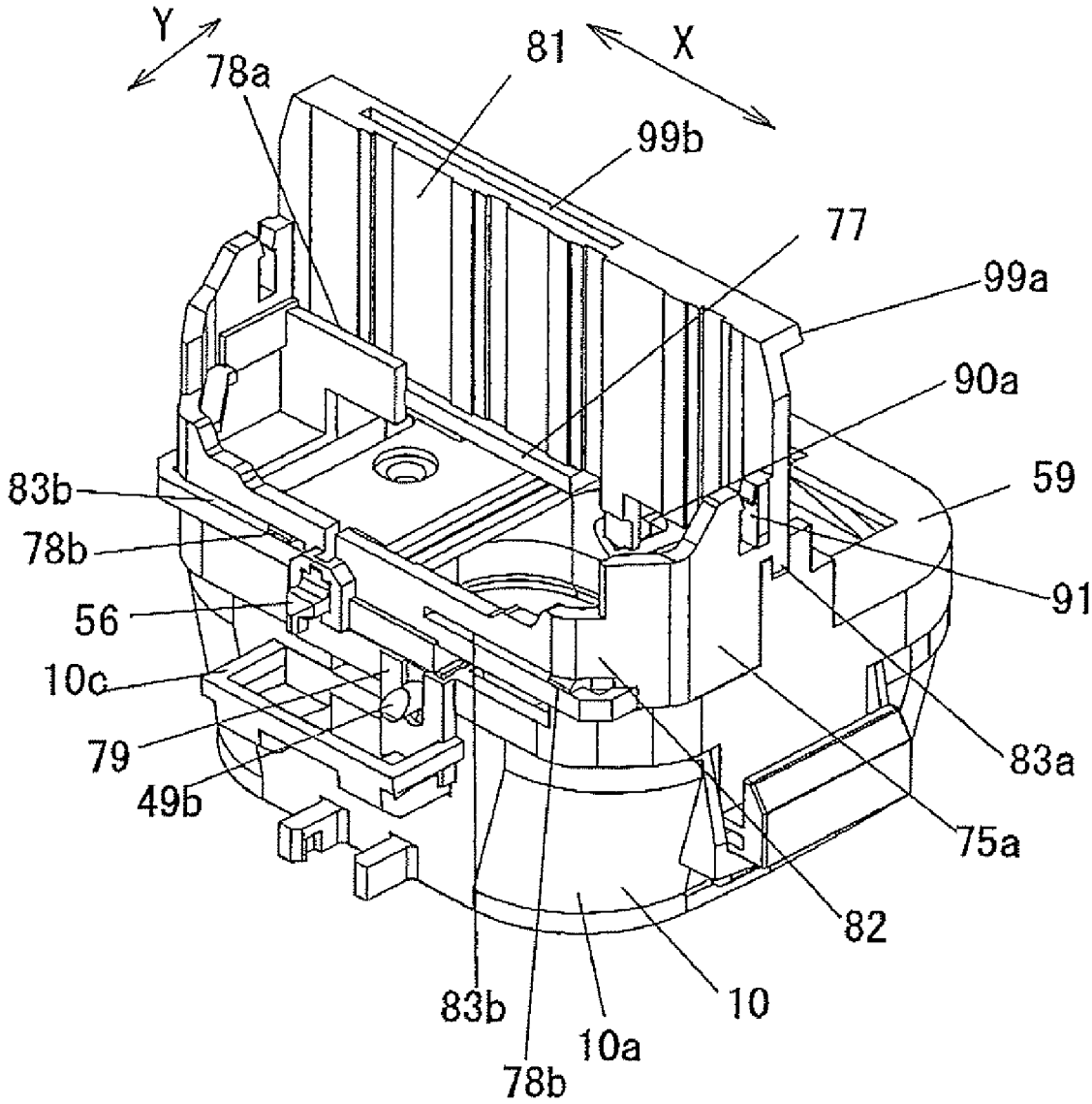
FIG. 31 is a perspective view of a state where the front frame main body portion is slidably mounted on a frame base.

As shown in FIG. 31, the rail fitting portion 83*a* of the frame main body portion 75*a* is slidably fitted into the rail portion 78*a*, and the slide projection 78*b* is slidably fitted into the rail portion 83*b*. With this configuration, the frame main body portion 75*a* is slidably mounted on a front half portion of the main frame base 59 in the lateral direction.

The locking hole 54 and the frame lock member 53 which is biased by the spring and which has the locking projection 53*a* constitute the fixing unit 3. The locking projection 53*a* is fitted into one of the two locking holes 54 corresponding to the initial position, the frame main body portion 75*a* (i.e., the frame main body portion 75) is connected to and fixed to the front portion of the main frame base 59, the locking projection 53*a* is fitted into one of the two locking holes 54 corresponding to the sliding position, the frame main body portion 75*a* (i.e., the frame main body portion 75) is connected to and fixed to the front portion of the main frame base 59.

Here, as shown in FIG. 28, left and right inner surfaces of the locking hole 54 are inclined such that the lateral width is increased downward, the locking projection 53*a* which is tapered toward its tip end is fitted into the locking hole 54 whose lateral width is increased downward and locked and thus, if a force greater than a given value is applied in the sliding direction, the looked state is released.

The rear outer blade frame 2*b* is constituted by the frame main body portion 75*b* and the cover frame portion 76*b*.

Figure 33A:
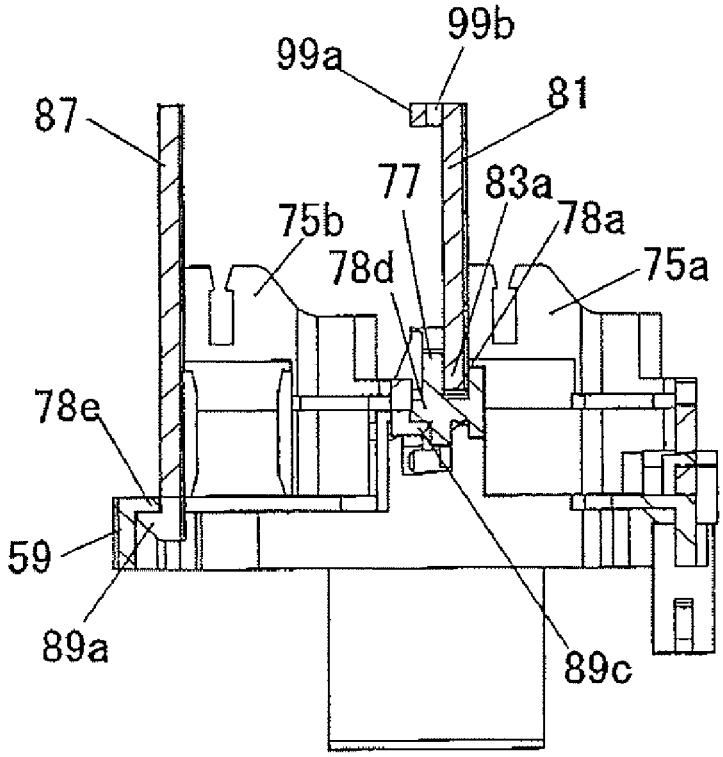
FIG. 33A is a side sectional view of a portion where the rear frame main body portion is slidably mounted on the frame base.
Figure 33B:
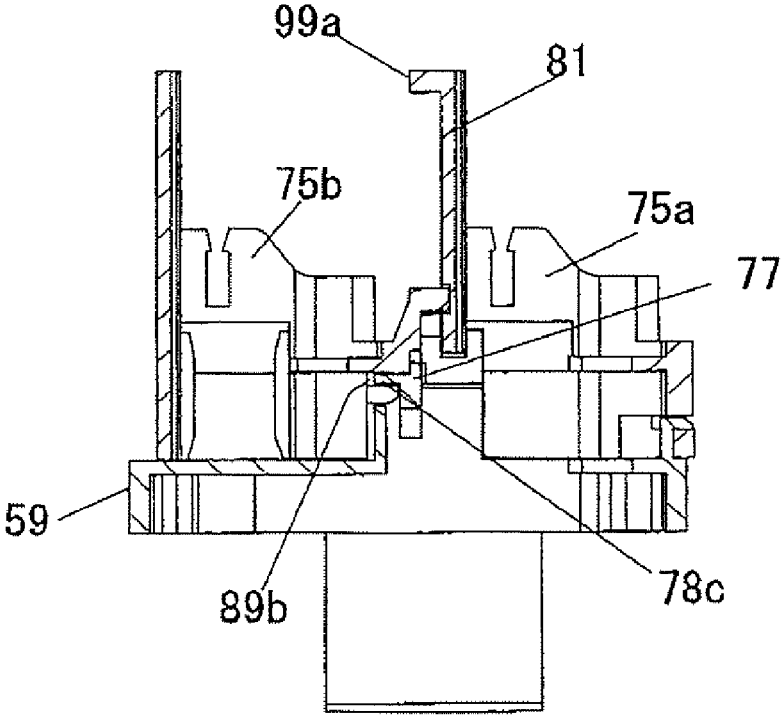
FIG. 33B is a side sectional view of another portion.

As shown in FIG. 17, the rear frame main body portion 75*b* is integrally provided with a U-shaped frame portion 88 which forwardly projects from a lower end of a vertical rear wall plate portion 87. As shown in FIGS. 33A and 33B, a slide retaining unit 89*a* projects rearward from a lower end of the rear wall plate portion 87, a rail groove portion 89*b* is provided on a substantially one side half portion (left side in the embodiment) of a front end of the frame portion 88, and a slide projection 89*c* is provided on a front end of the frame portion 88.

As shown in FIGS. 33A and 33B, the slide retaining unit 89*a* of the rear frame main body portion 75*b* is slidably retained to the rear slide rail portion 78*e* of the main frame base 59, the slide projection 78*c* is slidably fitted into the rail groove portion 89*b*, and the slide projection 89*c* is slidably fitted into the slide rail portion 78*d*. With this configuration, the frame main body portion 75*b* is mounted on a rear half portion of the main frame base 59 such that the frame main body portion 75 can slide in the lateral direction.

The long hole 51*b* formed in one end of the association lever 51*a* which is turnably mounted on the central bridging piece 77 is fitted over a shaft portion 90*a* formed on a front end of the frame portion 88 of the rear frame main body portion 75*b* such that the long hole 51*b* can slide and turn, the long hole 51*b* formed in the other end of the association lever 51*a* is slidably and turnably fitted over a shaft portion 90*b* projecting from a rear surface of the front wall plate portion 81 of the frame main body portion 75*a*, and if the frame main body portion 75*a* (i.e., the front outer blade frame 2*a*) slides, the frame main body portion 75*b* (i.e., rear outer blade frame 2*b*) is slid in the opposite direction through the association lever 51*a* in association.

That is, in the initial position, the operation button 57*a* is rearwardly pushed to release the fitting state of the locking projection 53*a* with respect to the locking hole 54, and if the front outer blade frame 2*a* slides from the initial position to the sliding position (the left sliding position in the drawings), since the shaft portions 90*a* and 90*b* are slidably fitted to the long holes 51*b* the association lever 51*a* turns in one direction, the association lever 51*a* turns, the rear outer blade frame 2*b* slides from the initial position to the sliding position (the right sliding position) in association, and in the sliding position, the operation button 57*a* is rearwardly pushed to release the fitting state of the locking projection 53*a* with respect to the locking hole 54, and if the front outer blade frame 2*a* slides from the sliding position (the left sliding position in the drawings) to the initial position, since the shaft portions 90*a* and 90*b* are slidably fitted into the long holes 51*b*, the association lever 51*a* turns in the opposite direction, the association lever 51*a* turns, and the rear outer blade frame 2*b* slides from the sliding position (the right sliding position) to the initial position in association.

Here, when the operation button 57*a* is pushed in the initial position and the sliding position, the locking projection 53*a* is fitted into the locking hole 54 and the front outer blade frame 2*a* is fixed such that it cannot slide with respect to the main frame base 59, the rear outer blade frame 2*b* connected through the association lever 51*a* is fixed such that it cannot slide with respect to the main frame base 59, the locking projection 49*a* is fitted into the lock hole 50, the front movable-side drive element portion 41*a* is fixed such that it cannot slide with respect to the drive source-side drive element portion 42, and the rear movable element-side drive element portion 41*b* connected through the drive element lever 69 is fixed such that it cannot slide with respect to the drive source-side drive element portion 42.

The front end of the connection pin 85 is in abutment against or is close to a rear surface of the operation button 57*a*, and a state where the operation button 57*a* is not pushed rearward, the rear end of the connection pin 85 is not fitted into the connection hole 41*e* formed in the front movable-side drive element portion 41*a*.

Therefore, in a state where the operation button 57*a* is not operated in any of the initial position and the sliding position and the front and rear outer blade frames 2*a* and 2*b* are fixed to the main frame base 59 and the front and rear movable blade-side drive element portions 41*a* and 41*b* are fixed to the drive source-side drive element portion 42, the front movable-side drive element portion 41*a* which supports the movable blade 39 at the upper end reciprocates in the front outer blade frame 2*a*, the rear movable blade-side drive element portion 41*b* which supports the movable blade 39 at the upper end reciprocates in the rear outer blade frame 2*b*, and the reciprocating movable blade 39 and outer blade 38 cut hair.

In the initial position and the sliding position, if the operation button 57*a* is rearwardly pushed and the connection between the locking hole 54 and the locking projection 53*a* is released and the connection between the lock hole 50 and the locking projection 49*a* is released, the connection in 85 is pushed rearward against the spring 86 at the same time, the rear end of the connection pin 85 is fitted into the connection hole 41*e* of the front movable-side drive element portion 41*a*, and the front outer blade frame 2*a* and the front movable-side drive element portion 41*a* are connected to each other. Therefore, in the initial position and the sliding position, in a state where the operation button 57*a* is pushed rearward, the front outer blade frame 2*a* and the front movable-side drive element portion 41*a* slide in association. At that time, the front outer blade frame 2*a* and the rear outer blade frame 2*b* are associated with each other, and the front movable-side drive element portion 41*a* and the rear movable element-side drive element portion 41*b* are associated with each other. Therefore, the front and rear outer blade frames 2*a* and 2*b* and the front and rear movable blade-side drive element portions 41*a* and 41*b* slide in association.

When the operation button 57*a* is pushed to fit the connection pin 85 into the connection hole 41*e*, since the movable blade-side drive element portion 41*a* disposed such as to reciprocate in the front outer blade frame 2*a* is stopped at an arbitrary position in the reciprocating range, the stop position of the movable blade-side drive element portion 41*a* in the outer blade frame 2*a* is not constant in any of the initial position and sliding position, and the connection hole 41*e* and the connection pin 85 do not always coincident. Hence, in the present invention, the front portion of the connection hole 41*e* is formed such that the lateral hole width is increased forward as shown in FIG. 29 so that even when the connection pin 85 and the connection hole 41*e* are slightly deviated, the connection pin as can smoothly enter the entrance of the connection hole 41*e* having wide width (i.e., widened in ˆ-shaped).

In the present invention, there is provided an arrangement direction position holding unit 55 which holds a positional relationship in the arrangement direction of the arranged outer blade frames 2. That is, as shown in FIGS. 16, 17, 18, and 19, a convex stripe portion 99*a* projects rearward from an upper end of the front wall plate portion 81 of the frame main body portion 75*a*, and the convex stripe portion 99*a* is provided with a long hole 99*b* which is long in the sliding position (X direction). The rear cover frame portion 76*b* is provided at its front surface with a projection 100 which projects upward, and a tip end of the projection 100 is slidably fitted into the long hole 99*b*. The arrangement direction position holding unit 55 includes the long hole 99*b* and the projection 100, the arranged front and rear outer blade frames 2*a* and 2*b* are prevented from opening or narrowing in the arrangement direction, the front and rear outer blade frames 2*a* and 2*b* can stably be used in a using mode where the shaving area width M is widened and in a using mode where the shaving area width M is narrowed, and the sliding motion can be stably and smoothly carried out.

FIGS. 37 to 43 show another embodiment of the present invention.

Figure 37:
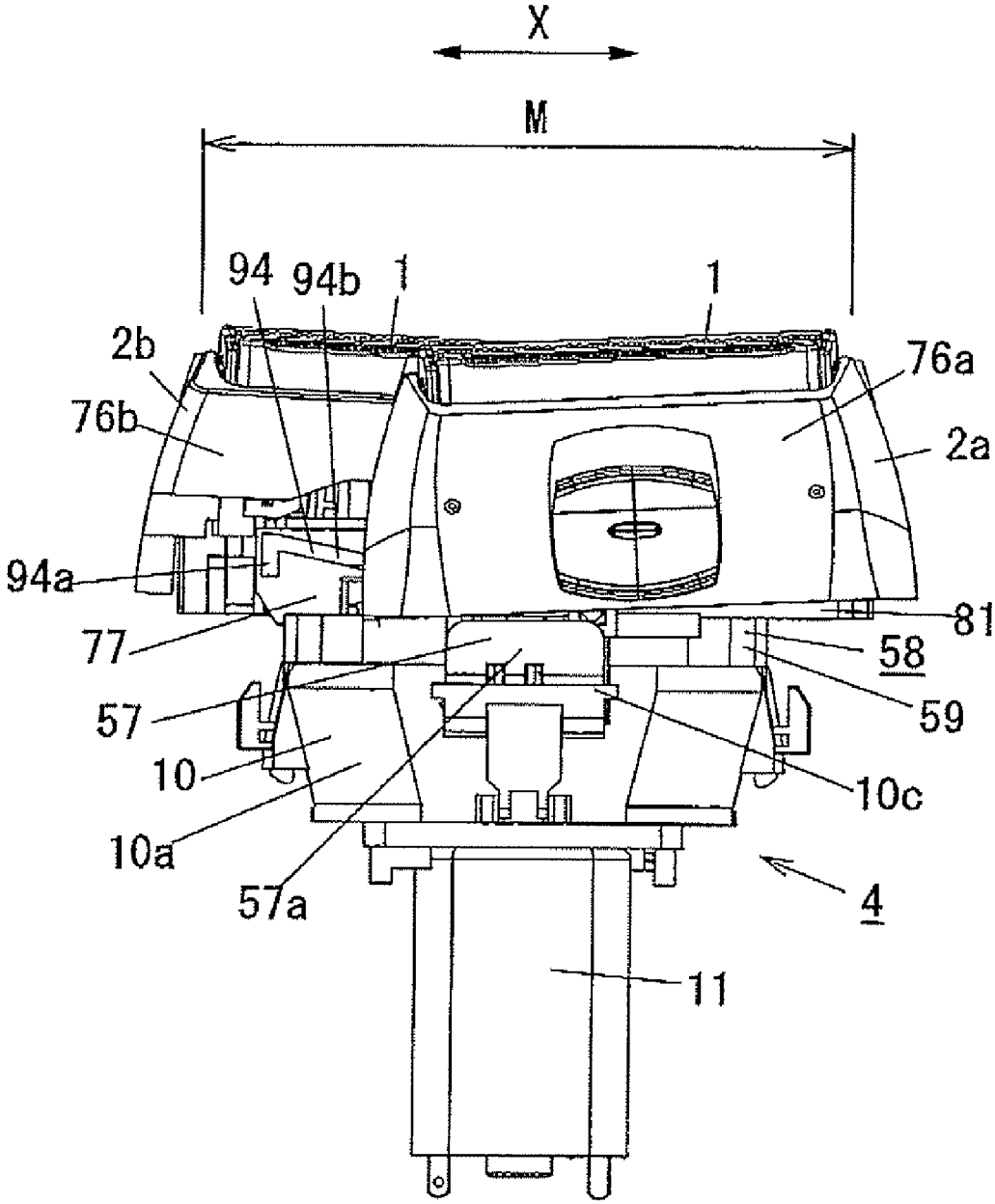
FIG. 37 is a front view when an outer blade frame is slid and a shaving area width is elongated in a state where a housing of another embodiment of the invention is omitted.
Figure 38:
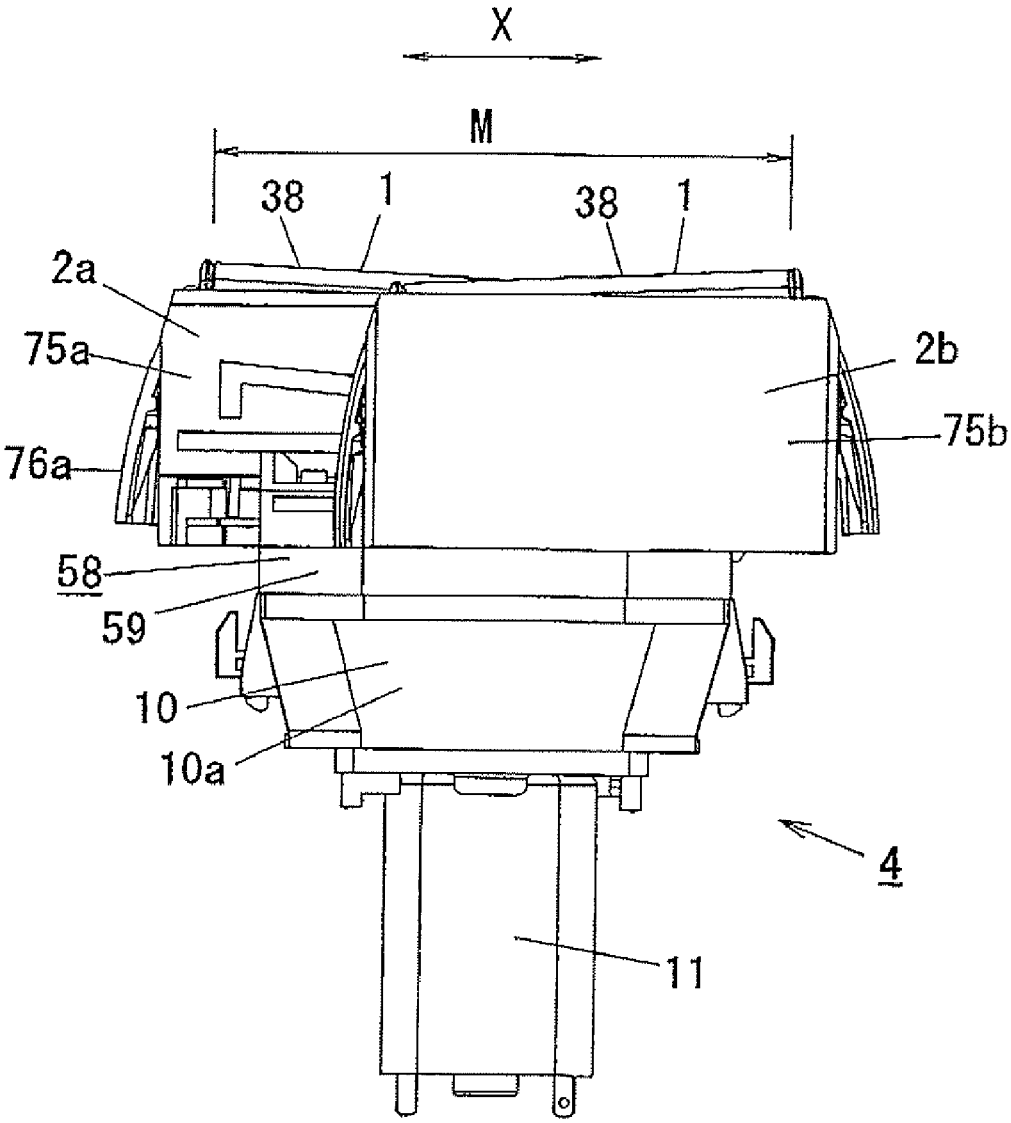
FIG. 38 is a rear view when the outer blade frame is slid and the shaving area width is elongated in a state where the housing is omitted.
Figure 39:
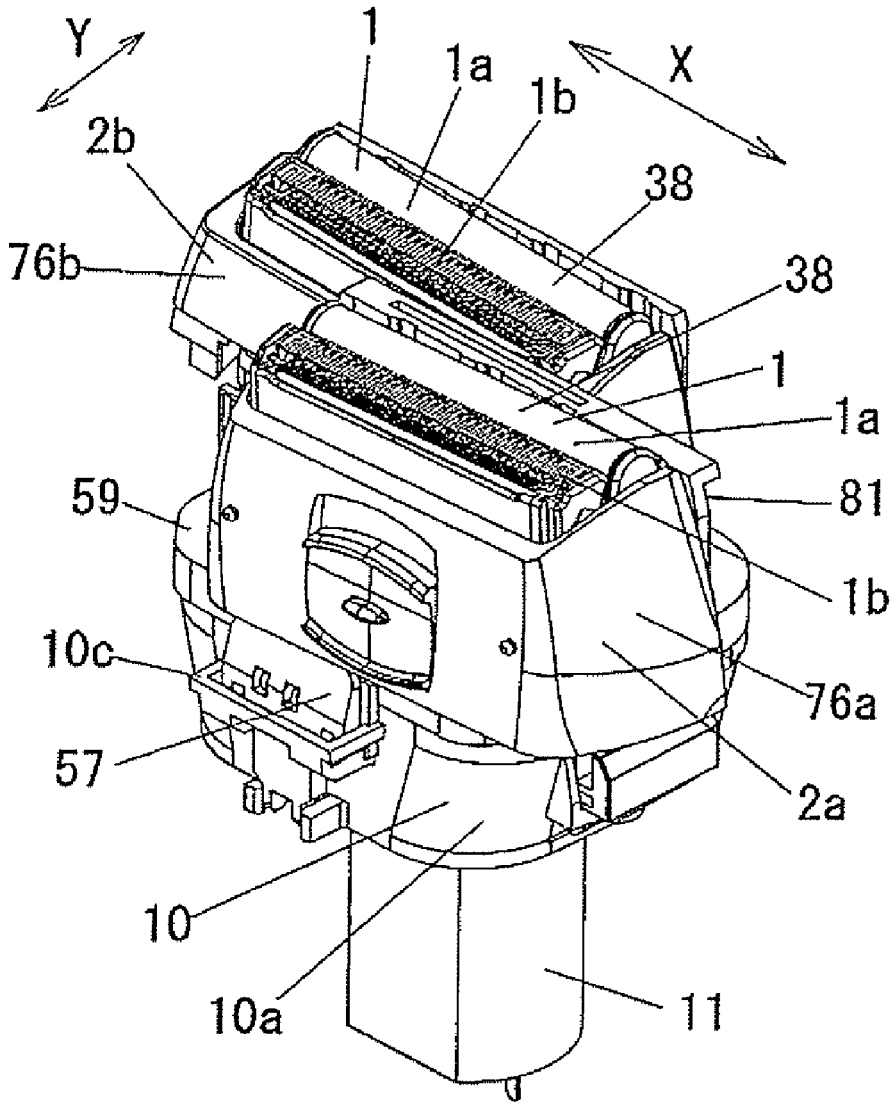
FIG. 39 is a perspective view when the outer blade frame is slid and the shaving area width is elongated in a state where the housing is omitted.

In the above embodiment, the outer blade frames 2 are slid and arranged in the moving direction of the movable blade 39 from the initial position, and the shaving area width M is widened by the outer blade 38 which holds the outer blade frames 2. In this state, the arranged outer blade frames 2 are in parallel to each other. In the present embodiment, in a state where the shaving area width M is widened by the outer blade 38 which is held by the outer blade frames 2 which slide in the moving direction of the movable blade 39 from the initial position and arranged, as shown in FIGS. 37 to 39, the arranged outer blade frames 2 slide and incline with respect to the initial position such that the arranged outer blade 38 projects further from central portions of the both ends of the shaving area width M. With this configuration, when the shaving area width M is widened and hair of an arm or a leg is to be cut, the outer blade easily come into close contact with a curved surface of the arm or the leg and the amount of hair which is left unshaved is small, and the shaving operation can be swiftly carried out.

Here, the arranged entire outer blade frames 2 may incline at the sliding position or a portion of constituent members of the arranged outer blade frames 2 may incline at the sliding position.

In the embodiment shown in FIGS. 37 to 43, the portion of the constituent members of the arranged outer blade frames is inclined at the sliding position.

That is, like the previous embodiment, the frame main body portion 75*a* and the rear frame main body portion 75*b* are mounted on the main frame base 59 such that they can slide in the lateral direction, they slide while keeping the parallel relationship, the front cover frame portion 76*a* is mounted such that it can vertically move within a constant range with respect to the frame main body portion 75*a*, and the rear cover frame portion 76*b* is mounted such that it can vertically move within a constant range with respect to the frame main body portion 75*b*.

Figure 40:
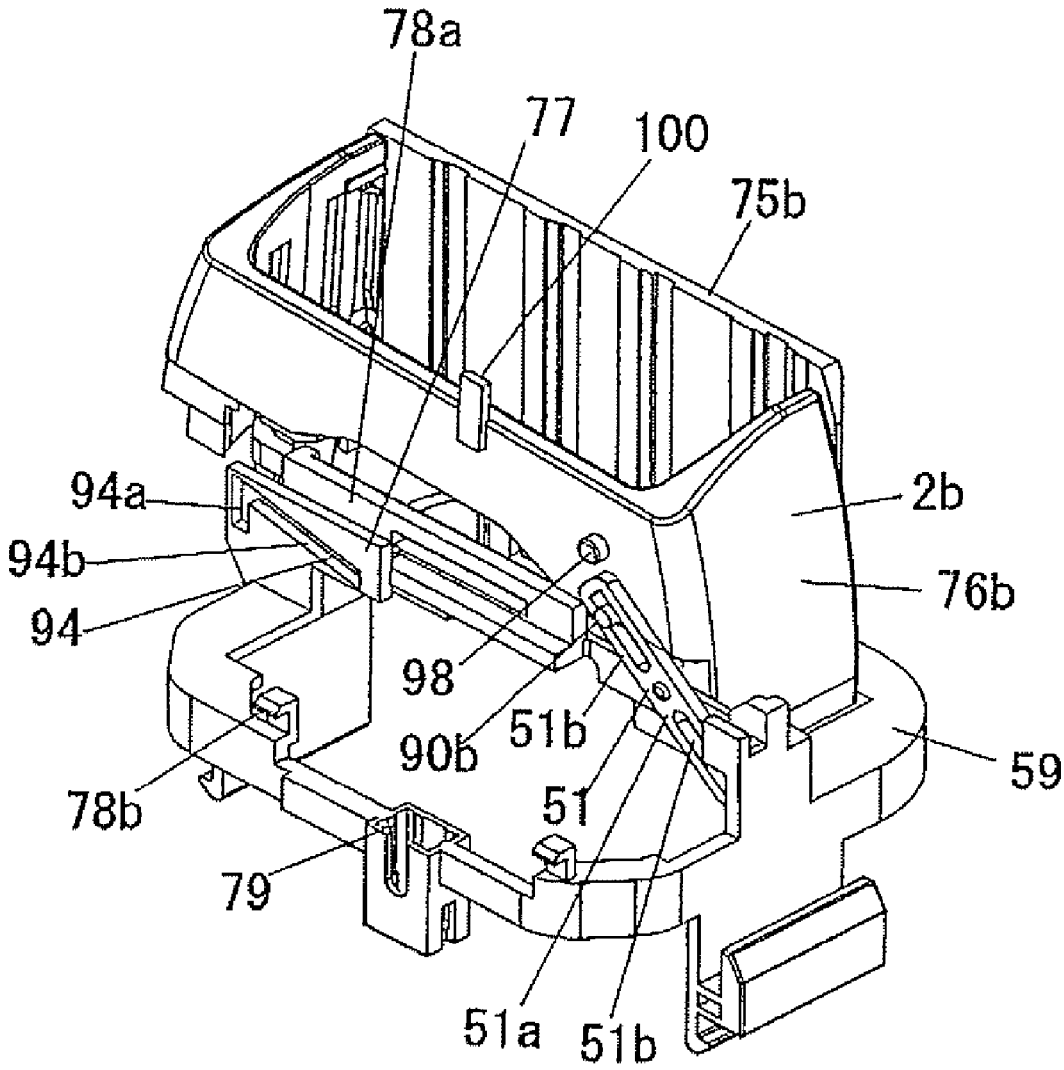
FIG. 40 is a perspective view of a taper guide portion provided on a main frame base.
Figure 41:
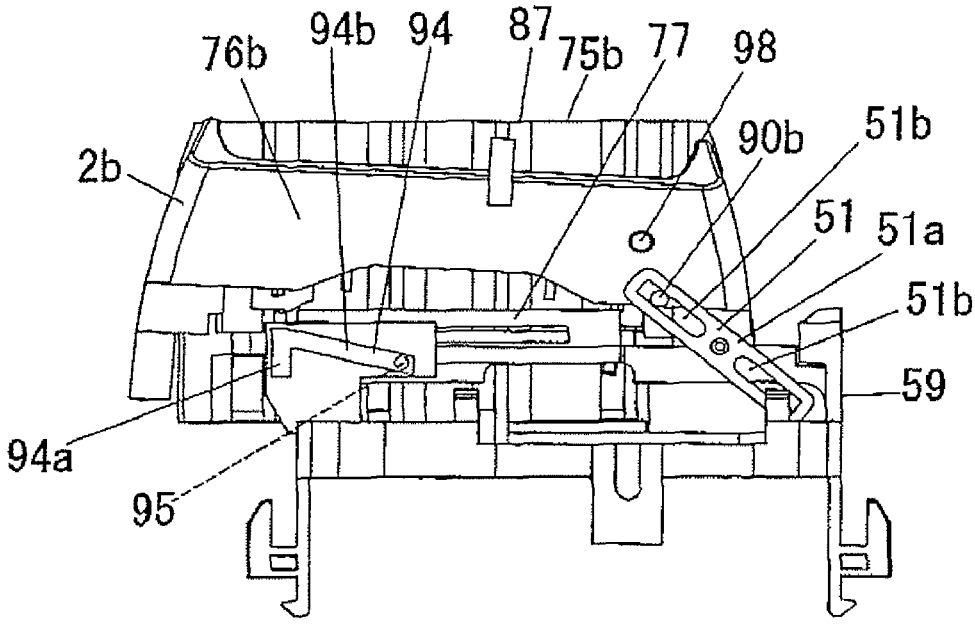
FIG. 41 is a front view of the taper guide portion provided on the main frame base.

The central bridging piece 77 extends at a central portion of the main frame base 59 in the longitudinal direction, a taper guide portion 94 including a vertical groove 94*a* and an inclined groove 94*b* (inclined downward as separating away from the vertical groove 94*a*) which is in communication with an upper end of the vertical groove 94*a* is provided on a front surface side of one end of the central bridging piece 77 in the lateral direction as shown in FIGS. 37, 40, and 41, and a projection 95 provided on a rear end of a left or right end of the front cover frame portion 76*a* is movably fitted to the taper guide portion 94. In a state where the front cover frame portion 76*a* is located at the initial position, the projection 95 is located at an upper end of the inclined groove 94*b* (upper end of the vertical groove 94*a*), and in a state where the front cover frame portion 76*a* is located at the sliding position, the projection 95 is located at a lower end of the inclined groove 94*b*. In a state where the front cover frame portion 76*a* is located at the initial position, the front cover frame portion 76*a* is in parallel to the frame main body portion 75*a* which slides with respect to the main frame base 59 and thus, in a state where the front cover frame portion 76*a* is located at the sliding position, the front cover frame portion 76*a* is inclined with respect to the sliding direction (state where the end opposite from the slide moving direction is inclined downward).

Figure 42:
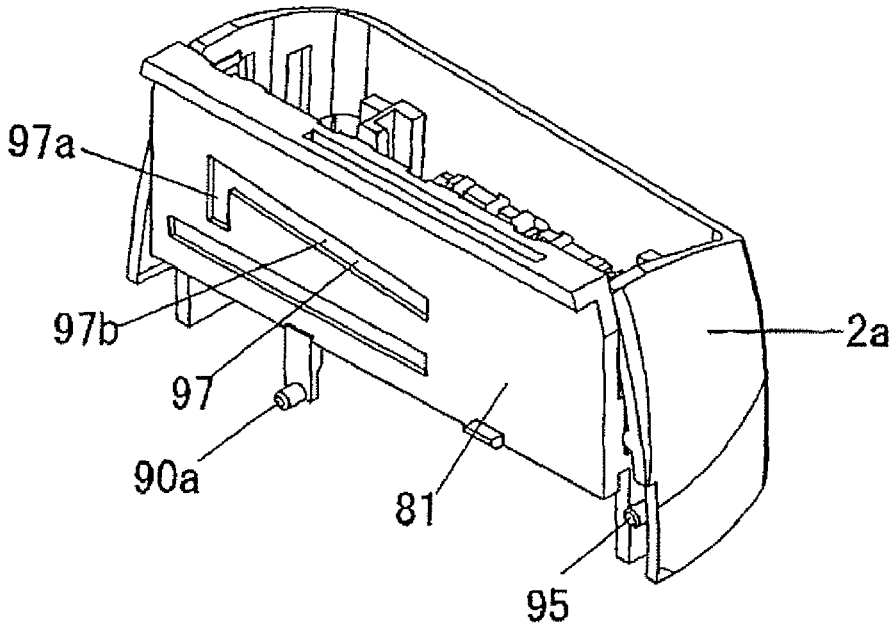
FIG. 42 is a perspective view of a taper guide portion provided on a front outer blade frame.
Figure 43:
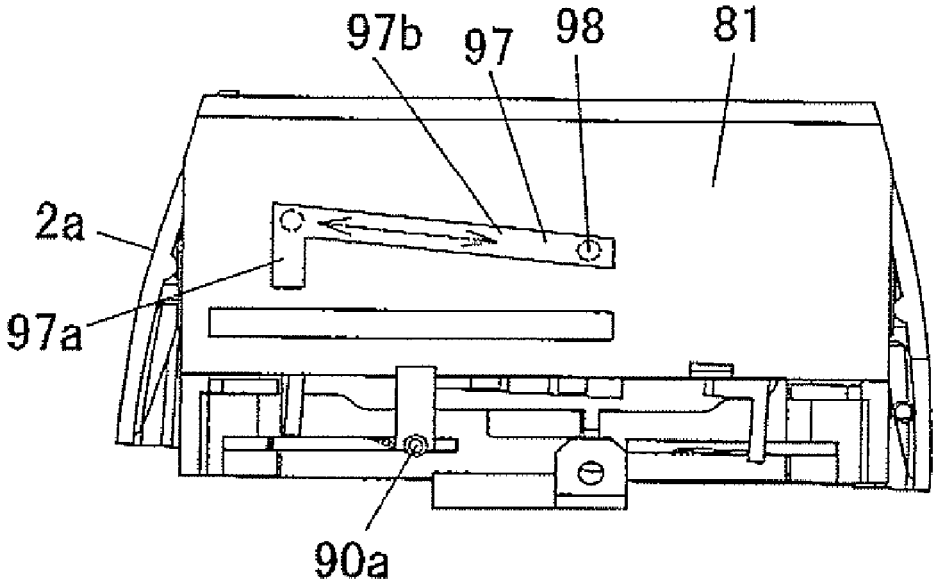
FIG. 43 is a front view of the taper guide portion provided on the front outer blade frame.

As shown in FIGS. 30, 42, and 43, the frame main body portion 75*a* is provided at its rear surface with a taper guide portion 97 including a vertical groove 97*a* and an inclined groove 97*b* (inclined downward as separating away from the vertical groove 97*a*) which is in communication with an upper end of the vertical groove 97*a*, and a projection 98 provided on a right or left end of a front surface of the rear cover frame portion 76*b* is movably fitted to the taper guide portion 97. In a state where the rear cover frame portion 76*a* is located at the initial position, the projection 98 is located at an upper end of the inclined groove 97*b* (an upper end of the vertical groove 97*a*), and in a state where the rear cover frame portion 76*b* is located at the sliding position, the projection 98 is located at a lower end of the inclined groove 97*b*. In a state where the rear cover frame portion 76*b* is located at the initial position, the rear cover frame portion 76*b* is in parallel to the rear frame main body portion 75*b* which slides with respect to the main frame base 59 and thus, in a state where the rear cover frame portion 76*b* is located at the sliding position, the rear cover frame portion 76*b* is inclined with respect to the sliding direction (a state where the end opposite from the slide moving direction is inclined downward).

With the above configuration, in a using mode in which the front and rear outer blade frames 2*a* and 2*b* are located at the initial positions and the shaving area width M is the narrowest (short) that can be shaved at a time by the entire blade block 1, the outer blades 38 (and a trimmer blade) provided on the outer blade frames 2*a* and 2*b* are in parallel, and it is possible to effectively cut hair at a location where the shaving area is narrow such as an armpit.

As shown in FIGS. 37 to 39, in a state where the front and rear outer blade frames 2*a* and 2*b* are slid in the opposite directions from each other, i.e., in a using mode where the shaving area width M that can be shaved at a time by the entire blade block 1 is the widest (long), the outer blades 38 (and trimmer blades) provided on the outer blade frames 2*a* and 2*b* are inclined such that both ends of the shaving area width M project more than its central portion. Thus, when the shaving area width M is widened and hair of an arm or a leg is to be cut, the outer blade easily come into close contact with a curved surface of the arm or the leg and the amount of hair which is left shaved is small, and the shaving operation can be swiftly carried out.

Since the taper guide portion 94 is provided with the vertical groove 94*a* and the taper guide portion 97 is provided with the vertical groove 97*a*, even when a pushing down force is applied to the outer blade 38 from above in a state where the front and rear outer blade frames 2*a* and 2*b* are located at the initial positions, the projections 95 and 98 can move along the vertical rove 94*a* and the vertical groove 97*a*, and the outer blade 38 can float.

According to the invention, in any of a narrow portion such as an armpit and a wide portion such as a leg or an arm, the shaving width of the shaver blade can assume a shaving area width optimal for the respective portions, the blade can easily come into contact with a skin in the narrow portion such as the armpit and hair can be cut smoothly and swiftly, and using comfort is excellent, and in the wide portion such as the leg and the arm, the amount of hair that can be shaved with one stroke is increased and hair can be shaved swiftly, and since the outer blade frame is fixed by the fixing unit at the sliding position, hair can be cut in a state where a shaving area width set by the slide is maintained when the shaver is used in a state where the outer blade frame is slid, and there is an effect that hair can be cut stably and reliably.

Although the invention is not limited to the embodiments described above. Modifications and variations of the embodiments described above will occur to those skilled in the art, in light of the teachings. The scope of the invention is defined with reference to the following claims.

What is claimed is:

1. A shaver comprising:

a shaver main body;

first and second outer blade frames provided on an upper portion of the shaver main body, the first outer blade frame having a first blade block for cutting hair, the first blade block having a first movable blade, the second outer blade frame having a second blade block for cutting hair, the second blade block having a second movable blade, wherein the first movable blade is driven by one drive source to reciprocate relative to the first outer blade frame in a reciprocal cutting direction, wherein the second movable blade is driven by the one drive source to reciprocate relative to the second outer blade frame in the reciprocal cutting direction, wherein the first and the second outer blade frames are arranged in a direction perpendicular to the reciprocal cutting direction, and wherein at least one of the first and the second outer blade frames slide in the reciprocal cutting direction from an initial position relative to the shaver main body; and a fixing unit for fixing the first and the second outer blade frames at a sliding position in the reciprocal cutting direction.

2. A shaver comprising:

a shaver main body;

a plurality of outer blade frames each having a blade block for cutting hair, and provided on an upper portion of the shaver main body, each blade block having movable blades, respectively, wherein the movable blades of each blade block are driven by one drive source to reciprocate relative to the corresponding outer blade frame in a reciprocal cutting direction, wherein the plurality of outer blade frames are arranged in a direction perpendicular to the reciprocal cutting direction, and wherein at least one of the plurality of outer blade frames slides in the reciprocal cutting direction from an initial position relative to the shaver main body; and a fixing unit for fixing the plurality of outer blade frames at a sliding position in the reciprocal cutting direction.

3. The shaver according to claim 2, wherein the outer blade frames slide in different directions.

4. The shaver according to claim 3, wherein the plurality of outer blade frames slide by an outer blade frame associating unit, and wherein the outer blade frame associating unit is configured to slide one of the plurality of outer blade frames in response to sliding movement of another of one of the plurality of outer blade frames.

5. The shaver according to claim 3, further comprising an arrangement direction position holding unit which holds a positional relationship of the arranged plurality of outer blade frames in an arrangement direction.

6. The shaver according to claim 2, wherein a drive element which is driven by the drive source and which reciprocates the movable blade is divided into a drive source-side drive element portion on a drive source side and a movable blade-side drive element portion on a movable blade side, the movable blade-side drive element portion is mounted on the drive source-side drive element portion such that the movable blade-side drive element portion slides in the reciprocal cutting direction of the movable blade.

7. The shaver according to claim 6, wherein a plurality of movable blade-side drive element portions slide in association by a drive element associating unit.

8. The shaver according to claim 6, further comprising a drive element connecting unit which connects the movable blade-side drive element portion and the drive source-side drive element portion, and a spring member configured such that the movable blade-side drive element portion slides from the initial position to the sliding position or from the sliding position to the initial position with respect to the drive source-side drive element portion.

9. The shaver according to claim 8, wherein the drive element connecting unit comprises a drive element lock member which is biased by a spring provided on the drive source-side drive element portion, and a lock hole into which the drive element lock member provided on the movable blade-side drive element portion is fitted, the drive element lock member being fitted into the lock hole and a position of slide of the movable blade-side drive element portion is fixed.

10. The shaver according to claim 8, wherein the plurality of outer blade frames are each provided with a connecting member which detachably connects the movable blade-side drive element portion and the outer blade frame with each other, the outer blade frame and the movable blade-side drive element portion slide simultaneously in a state where the outer blade frame and the movable blade-side drive element portion are connected to each other by the connecting member, and the movable blade-side drive element portion can reciprocate in the outer blade frame in a state where the outer blade frame and the movable blade-side drive element portion are not connected to each other by the connecting member.

11. The shaver according to claim 10, further comprising a common operating unit which releases the connection between the movable blade-side drive element portion and the drive source-side drive element portion established by the drive element connecting unit, releases a connection between the shaver main body and the outer blade frame established by the fixing unit of the outer blade frame, and connects the movable blade-side drive element portion and the outer blade frame to each other by the connecting member.

12. The shaver according to claim 6, where the movable blade-side drive element portion and the drive source-side drive element portion slide by a rail structure comprising a recess and a protrusion, the rail structure is provided at its end with a stopper for a sliding motion.

13. The shaver according to claim 2, wherein the at least one of the plurality of outer blade frames is mounted on the shaver main body such that the outer blade frame slides in the reciprocal cutting direction of the movable blade, the fixing unit of the at least one of the plurality of outer blade frames comprises a frame lock member biased by a spring provided on a side of the shaver main body, and a lock hole into which the frame lock member provided on the outer blade frame is fitted, the frame lock member being fitted into the lock hole and a slide position of the outer blade frame is fixed.

14. The shaver according to claim 2, wherein in a state where the at least one of the plurality of outer blade frames is slid in the reciprocal cutting direction of the movable blade from the initial position, a shaving area width established by an outer blade held by the arranged outer blade frames is widened, the arranged outer blade frames are formed such that both ends of the shaving area width project more than an initial central position of the outer blade frames.

15. The shaver according to claim 2, further comprising an output side gear which outputs a driving force, a drive gear to which rotation is transmitted from the output side gear and which rotates, a drive element which converts the rotation of the drive gear into a reciprocating motion through an eccentric cam and which reciprocates the movable blade of the blade block, and a plurality of output side auxiliary gears, wherein the drive gear, the eccentric cam and the drive element slide together with the at least one of the plurality of outer blade frames, and the driving force is transmitted to the drive gear through the output side auxiliary gears in the initial position and the sliding position of the at least one of the plurality of outer blade frames.

* * * * *